US009656485B2

(12) United States Patent
Asai et al.

(10) Patent No.: US 9,656,485 B2
(45) Date of Patent: May 23, 2017

(54) CONVEYOR LINE SYSTEM AND CONVEYING CONTAINER

(71) Applicants: Toshiaki Asai, Shizuoka (JP); Tomomi Ishimi, Shizuoka (JP); Katsuya Ohi, Shizuoka (JP)

(72) Inventors: Toshiaki Asai, Shizuoka (JP); Tomomi Ishimi, Shizuoka (JP); Katsuya Ohi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/121,115

(22) PCT Filed: Mar. 6, 2015

(86) PCT No.: PCT/JP2015/057398
§ 371 (c)(1),
(2) Date: Aug. 24, 2016

(87) PCT Pub. No.: WO2015/137476
PCT Pub. Date: Sep. 17, 2015

(65) Prior Publication Data

US 2017/0015111 A1 Jan. 19, 2017

(30) Foreign Application Priority Data

Mar. 13, 2014 (JP) ..... 2014-050445

(51) Int. Cl.
*B41J 2/15* (2006.01)
*B41J 11/00* (2006.01)

(52) U.S. Cl.
CPC ..... *B41J 11/007* (2013.01)

(58) Field of Classification Search
CPC ..... B41J 2/32; B41J 2202/37; B41J 11/002; B41J 2002/4756; B41J 2/315
See application file for complete search history.

(56) References Cited

U.S. PATENT DOCUMENTS 6,677,273 B2 * 1/2004 Torii ..... B41M 5/305 347/177
7,439,993 B2 * 10/2008 Ishimi ..... B41J 2/471 347/179

(Continued)

FOREIGN PATENT DOCUMENTS

JP 2003-320692 11/2003
JP 2008-194905 8/2008

(Continued)

OTHER PUBLICATIONS

International Search Report Issued on Jun. 2, 2015 for counterpart International Patent Application No. PCT/JP2015/057398 filed Mar. 6, 2015.

*Primary Examiner* — Lamson Nguyen
(74) *Attorney, Agent, or Firm* — Cooper & Dunham LLP

(57) ABSTRACT

A conveyor line system, including: an image processing device configured to irradiate a recording part with laser light to record or erase, or record and erase an image, wherein the conveyor line system is configured to manage a conveying container containing the recording part, and wherein the following formula is satisfied at a wavelength of the laser light emitted from the image processing device when recording the image:

$$A+50>B$$

where A is an absorbance of the recording part, and B is an absorbance of the conveying container.

13 Claims, 10 Drawing Sheets

(56) References Cited

U.S. PATENT DOCUMENTS

| | | | |
|---|---|---|---|
| 2008/0192618 | A1 | 8/2008 | Nakata et al. |
| 2009/0203521 | A1 | 8/2009 | Ishimi et al. |
| 2012/0211673 | A1 | 8/2012 | Yamamoto |
| 2012/0212564 | A1 | 8/2012 | Yamamoto et al. |
| 2013/0135425 | A1 | 5/2013 | Yamamoto |
| 2013/0141512 | A1 | 6/2013 | Asai et al. |
| 2014/0099574 | A1 | 4/2014 | Kawahara et al. |
| 2014/0152756 | A1 | 6/2014 | Ishikake et al. |
| 2014/0158771 | A1 | 6/2014 | Ohi et al. |
| 2014/0285606 | A1 | 9/2014 | Ishimi et al. |

FOREIGN PATENT DOCUMENTS

| | | |
|---|---|---|
| JP | 2010-280498 | 12/2010 |
| JP | 2011-025508 | 2/2011 |
| JP | 2013-111888 | 6/2013 |

* cited by examiner

CONVEYOR LINE SYSTEM AND CONVEYING CONTAINER

TECHNICAL FIELD

The present invention relates to a conveyor line system and a conveying container.

BACKGROUND ART

Conventionally, various types of a conveyor line system, which is configured to convey a conveying product to which a thermoreversible recording medium serving as a recording part is attached to the predetermined conveying direction, and irradiate the thermoreversible recording medium with laser light to rewrite an image, have been proposed (see, for example, PTLs 1, 2, and 3).

The conveyor line system is equipped with an image erasing device configured to irradiate a thermoreversible recording medium, to which an image has been recorded, with laser light to erase the image, and an image recording device configured to irradiate the thermoreversible recording medium, from which the image has been erased by the image erasing device, with laser light to record a new image. Note that, the image erasing device and the image recording device may be collectively referred as an image processing device.

It is desired that laser light is accurately applied only to a thermoreversible recording medium, when an image is recorded, or the formed image is erased by irradiating the thermoreversible recording medium with the laser light. In the conveyor line system, however, laser light may be repeatedly applied to, not only the thermoreversible recording medium, but also an area of a conveying container, which surrounds the thermoreversible recording medium. If laser light is repeatedly applied to the conveying container as described above, a surface of the conveying container may be scraped as illustrated in FIG. 1B depending on a constitutional material or structure of the conveying container, because the conveying container absorbs the laser light. FIG. 1A is a photograph depicting a surface of a conveying container formed of a black polypropylene (PP) resin plate before laser light is applied, and FIG. 1B is a photograph depicting the surface of the conveying container formed of a black polypropylene (PP) resin plate after irradiated with laser light 10 times. Note that, a surface texture of the area irradiated with the laser light depicted in FIG. 1B was rough, as it was touched with a finger.

This is not a problem if the conveying container is disposal. However, the conveying container to which the thermoreversible recording medium serving as a recording part is attached is typically used repeatedly. Therefore, a surface of the conveying container is scratched, or scraped, as the material of the surface of the conveying container is melted or sublimated by repetitive use of the conveying container and irradiation of laser light. Moreover, there is a problem that the durability of the conveying container is low, as the surface of the conveying container is scraped.

Even when irradiation of laser light is performed on a surface of a conveying container only once, for example, confidential information is recorded on the surface of the conveying container depending on a relationship between absorbance of the recording part and the absorbance of the conveying container. Therefore, there is a problem of leakage of confidential information.

Two cases are considered whey the conveying container is irradiated with laser light.

The first case is a case where a thermoreversible recording medium is not attached to a position where laser light is applied, for example, as the thermoreversible recording medium attached to the conveying container is pealed, a conveying container, to which a thermoreversible recording medium is not attached, is mixed in the line by accident, or a direction of the conveying container is mistaken by a worker for putting the conveying container in the line.

The second case is a case where a position of the thermoreversible recording medium and a position where laser light is irradiated are mismatched, for example, as a position of the conveying container placed on the conveyor line is misregistered, or the thermoreversible recording medium attached to the conveying container is shifted from an appropriate position, or a position where the thermoreversible recording medium is stopped is misregistered because the conveying container conveyed at high speed go beyond the stopper due to excessive force, or the conveying container is bumped into the stopper with excessive speed to move back in the opposite direction to the conveying direction due to the reflection from the impact with the stopper, or there is an error in positioning information when the conveying containers of several sizes to which the thermoreversible recording media is attached to the different positions are conveyed, against the intention that the laser light irradiation position is changed per conveying container, or a shape of the conveying container is changed as it is repetitively used.

A rate of the misregistration caused due to the aforementioned two cases changes depending on a performance of the conveyor line for use, or the conveying container for use, but it is 10 or less relative to 100 conveying containers. It is considered based on the above that laser light applied to rewrite an image on the thermoreversible recording medium attached to one conveying container is applied to the conveying container at the maximum rate of 1/10 relative to the number of the processing repeated.

Meanwhile, it is desired to record as much information as possible to a thermoreversible recording medium. If the information is recorded on the entire surface of the thermoreversible recording medium to this end, the information is recorded to the edges of the thermoreversible recording medium, and thus a probability that laser light is applied also to the conveying container becomes high, as the misregistration occurs. In the case the image on the thermoreversible recording medium is erased, similarly, laser light is applied to the entire surface of the thermoreversible recording medium to erase the information recorded on the entire surface of the thermoreversible recording medium. If the misregistration occurs, therefore, laser light applied to erase the information of the edges of the thermoreversible recording medium is also applied to the conveying container.

Recently, a high throughput has been desired for a conveyor line system. To this end, a conveying speed of a conveying container needs to be set as fast as possible. Therefore, a conveying container is bumped into a stopper with a force, a misregistration becomes significant. In this case, a problem that laser light is applied to conveying container tends to occur.

As for a method for solving the aforementioned problem, for example, disclosed is a method where a sensor for detecting a thermoreversible recording medium is provided above a conveyor line, and laser light is not emitted at equal to or above the predetermined power when a thermoreversible recording medium is not detected (see PTL 4). This method can prevent a conveying container from being irradiated with light when a thermoreversible recording medium is not attached to a position where laser light is applied. However, there is a case where a position where a thermoreversible recording medium is attached and a position where laser light is applied are misregistered. Therefore, problems that a conveying container is scratched or scraped, and durability thereof is degraded by irradiating the conveying container with laser light have not yet solved.

CITATION LIST

Patent Literature

PTL 1: Japanese Patent (JP-B) No. 5009639

PTL 2: Japanese Patent Application Laid-Open (JP-A) No. 2010-280498

PTL 3: JP-A No. 2003-320692

PTL 4: JP-A No. 2013-111888

SUMMARY OF INVENTION

Technical Problem

Accordingly, the present invention aims to provide a conveyor line system, which can prevent scratches or scrapes of a conveying container, and low durability of a conveying container, caused by repetitive use.

Solution to Problem

As the means for solving the aforementioned problems, the conveyor line system of the present invention contains:

an image processing device configured to irradiate a recording part with laser light to record or erase, or record and erase an image, wherein the conveyor line system is configured to manage a conveying container containing the recording part, and wherein the following formula is satisfied at a wavelength of the laser light emitted from the image processing device when recording the image:

$$A+50>B$$

where A is an absorbance of the recording part, and B is an absorbance of the conveying container.

Advantageous Effects of Invention

The present invention can solve the aforementioned various problems in the art, achieve the aforementioned object, and provide a conveyor line system, which can prevent scratches or scrapes of a conveying container, and low durability of a conveying container, caused by repetitive use.

DESCRIPTION OF EMBODIMENTS

Conveyor Line System

Figure 1A:
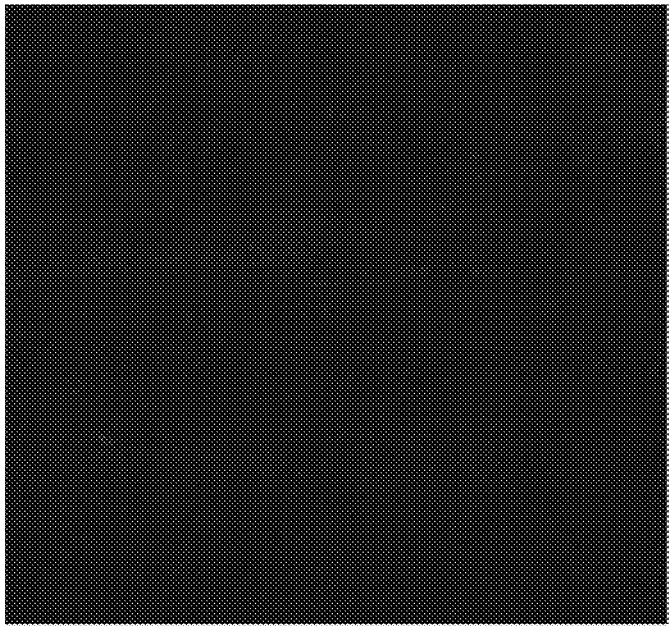
FIG. 1A is a photograph depicting a surface of a conveying container formed of a black polypropylene (PP) resin plate before irradiated with laser light.
Figure 1B:
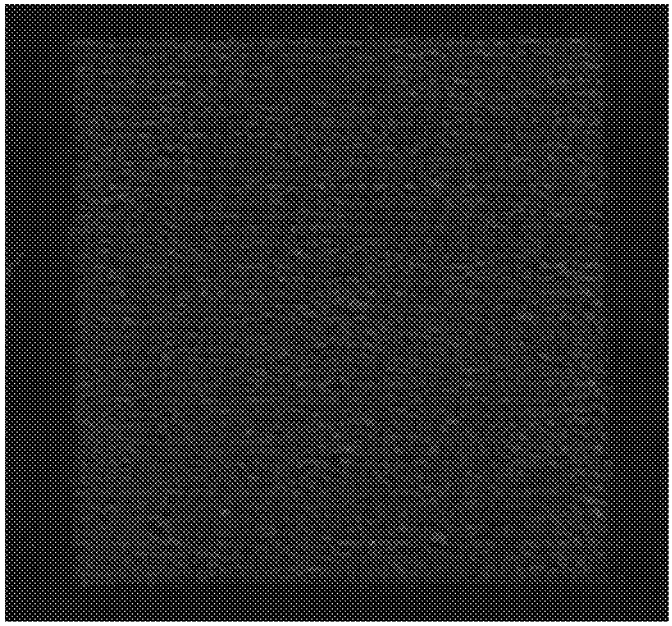
FIG. 1B a photograph depicting a surface of a conveying container formed of a black polypropylene (PP) resin plate after irradiated with laser light 10 times.

The conveyor line system of the present invention is a conveyor line system, which manages a conveying container containing a recording part, and contains at least an image processing device, which is configured to irradiate the recording part with laser light to record or erase, or record and erase an image. The conveyor line system of the present invention may further contain other devices, as necessary.

The conveyor line system is a system, which is configured to form an image, such as contents of products placed in the conveying container, information of a delivery destination, date, and a control number, by irradiating the recording part of the conveying container moved on a conveyor line with laser light.

The irradiation of laser light is performed when the recording part attached to the conveying container moved on the conveyor line reaches a predetermined position. The predetermined position is a position where the image processing device irradiates only the recording part with laser light in order to rewrite the image on the recording part. During this operation, it is preferred that the recording part be irradiated with laser light with controlling at least output of irradiation laser light, scanning speed, and beam diameter based on a result detected by a temperature sensor for detecting temperature of or surrounding temperature of the recording part, or a distance sensor for detecting a distance between the recording part and the image processing device, in order to obtain a high quality image.

In the conveyor line system, the energy of the laser light applied depends on the absorbance of the recording part at the wavelength of the laser light.

In the present specification, the energy of the laser light applied in the present invention is represented by P/(V*r), where P is the output of the laser light, V is the scanning speed, and r is the spot diameter on the recording part along a vertical direction relative to the scanning direction of the laser light.

The energy of the laser light applied is smaller, as the absorbance of the recording part at the wavelength of the laser light is greater. The energy of the laser light applied is greater, as the absorbance of the recording part at the wavelength of the laser light is smaller.

In the case where the recording part is a thermoreversible recording medium, an amount of the photothermal converting material, which absorbs laser light and converts the light to heat, contained in the thermoreversible recording medium increases, as the absorbance of the thermoreversible recording medium at the laser light wavelength is larger. Most of the photothermal converting materials have absorption in a visible ray range, not only with a wavelength of laser light. Therefore, contrast of an image formed on the thermoreversible recording medium is impaired when an amount of the photothermal converting material is increased.

The output of the irradiation laser increases, or the scanning speed reduces, as the absorbance of the recording part at the laser light wavelength is smaller.

From the reasons mentioned above, the absorbance of the recording part is adjusted to achieve both a desired contrast of an image on the recording part, and a desirable size or processing speed of the device.

In the case where the absorbance of the recording part at the laser light wavelength is large, in case of a thermoreversible recording medium serving as the recording part, heat is accumulated to form a coloring missing spot, or the heat generated in the reordering part is excessively high to thereby color even when erasion is performed, as the energy of the irradiation laser light is too high.

In the case where the absorbance of the recording part at the laser light wavelength is small, moreover, a blur image may be formed, or an erasion failure occurs in case of a thermoreversible recording medium serving as the recording part, as the energy of the irradiation laser light is too low.

From the reasons as mentioned above, the laser light having the energy corresponding to the laser light absorbance of the recording part is applied to the recording part in the conveyor line system.

In the conveyor line system, as mentioned earlier, there is a case where not only the recording part, but also the conveying container may be irradiated with laser light, as the position of the recording part and the position irradiated with the laser light are mismatched. A rate of the misregistration occurred changes depending on a performance of the conveyor line for use, or the conveying container for use, but it is 10 or less relative to about 100 conveying containers. It is considered based on the above that laser light applied to rewrite an image on the recording part of one conveying container is applied to the conveying container at the maximum rate of 1/10 relative to the number of the processing repeated.

In the conveyor line system of the present invention configured to manage a conveying container containing a recording part, at least an image processing device, which is configured to apply laser light to the recording part to perform image recording, or image erasing or both, is provided, and the image processing device satisfies the following formula at a wavelength of the laser light emitted from the image processing device at the time of the image recording:

$$A+50>B$$

In the formula above, A is an absorbance of the recording part, and B is an absorbance of the conveying container. As a result, scratches or scrapes on the conveying container, and reduction in durability of the conveying container can be prevented even when the conveying container is repeatedly irradiated with laser light. It is considered that this effect can be attained by the following reasons.

In order to maintain a shape as a container, a thickness of the conveying container is greater than a thickness of the recording part. As a result of this, a density of the laser light absorbing material in the recording part is high compared to a low density of the laser light absorbing material in the conveying container, for example, when the laser light absorbance of the recording part is identical to the laser light absorbance of the conveying container. Therefore, the conveying container is less likely thermally deteriorated compared to the recording part. As the density of the laser light absorbing material in the conveying container increases, in other words, laser light absorbance thereof increases, however, the conveying container is more likely deteriorated. When the absorbance A of the recording part and the absorbance B of the conveying container are in the ranges where the following formula A+50>B is satisfied, scratches or scrapes of the conveying container, and reduction in the durability of the conveying container can be prevented, even if the misregistration between the position of the recording part and the position where laser light is applied occurs.

In the present specification, the absorbance is represented by the following formula:

$$\text{Absorbance (\%)}=100-\text{reflectance (\%)}$$

The reflectance is a measured value measured by means of an integrating sphere type a visible-near IR spectrophotometer, relative to 100% of the reflectance of a $BaSO_4$ white board.

The absorbance of the conveying container is the average absorbance of the region on a surface of the conveying container to which the recording part is provided, and the region thereof is determined by excluding the region where the recording part is provided from the region surrounded by the region I and the region II. The region I of the conveying container is represented by −100 to 200, when an edge position of the recording part at the upstream side relative to the conveying direction is determined as 0, an edge position of the recording part at the downstream side relative to the conveying direction is determined as 100. The region II of the conveying container is represented by −100 to 200, when an edge position of the recording part far from the axis of the conveyor line orthogonal to the conveying direction is determined as 0, and the edge position of the recording part close to the conveyor line is determined as 100. Note that, the region, in which the conveying container is not included, within the surrounded region is not included as a calculation value of the average absorbance.

The absorbance of the recording part is the average absorbance of the entire surface of the recording part provided to the conveying container.

In order to prevent scratches or scrapes of the conveying container, and reduction in the durability of the conveying container, the absorbance A of the recording part and the absorbance B of the conveying container preferably satisfy the following formula A+10>B, and particularly preferably satisfy the following formula A>B.

When the absorbance A of the recording part and the absorbance B of the conveying container satisfy the following formula A+50≤B, an amount of heat generated in the conveying container is large, which may cause scratches or scrapes of the conveying container, and the reduction in the durability of the conveying container.

In case of a thermoreversible recording medium serving as a recording part, for example, if the thermoreversible recording medium cannot be used due to deterioration caused by repetitive irradiation of laser light prior to a disposal of the conveying container due to deterioration thereof, the conveying container can be continuously used by attaching a new thermoreversible recording medium thereon. It the conveying container cannot be used due to deterioration before the thermoreversible recording medium, on the other hand, it is necessary to attach the thermoreversible recording medium to a new conveying container. In this case, however, lines or scratches may be formed, or the thermoreversible recording medium may be bended, or a bending mark may be left, or the adhesion force of the thermoreversible recording medium is reduced when the thermoreversible recording medium is pealed from the disposal conveying container, as the thermoreversible recording medium is often fixed on the conveying container with a strong bonding agent or adhesive so that the conveying container is not easily released from the conveying container. Therefore, the thermoreversible recording medium cannot be reused by bonding to a new conveying container.

In the case where the present invention is a conveyor line system, in which an image recorded by an image recording device among the image processing device contains at least a solid image, it is preferred that the absorbance of the conveying container be smaller than the absorbance of the recording part at the wavelength of the laser light emitted from the image recording device.

The solid image means an image formed by overlapping at least several lines drawn by laser light, or an image formed by writing at least several lines by laser light next to each other. Examples of the solid image include: a two-dimensional code, such as a barcode, and QR code (registered trade mark); an outline character; a bold letter; logotype; a symbol; a shape; and a picture. Among them, a barcode is preferable as a solid image formed on the thermoreversible recording medium serving as the recording part used in the conveyor line system. Examples of the barcode include ITF, Code 128, Code 39, JAN, EAN, UPC, and NW-7.

Since the solid image is recorded by writing at least several lines overlapped each other or next to each other with laser light, heat is accumulated in the region of the conveying container where laser light is applied. When laser light is applied to the region where heat is accumulated, an amount of heat generated increases more compared to a case of an image formed with a single line. In this case, therefore, a surface of the conveying container is easily scraped. Accordingly, it is further preferred that the absorbance of the conveying container be smaller than the absorbance of the recording part, when an image recorded by the image recording device contains at least a solid image.

In the case where there are a few solid images, moreover, an image may be formed at a position closer to a center of the recording part, as the number of lines drawn by laser light, which constitute the solid image, increases.

If a degree of a misregistration is small, a probability that laser light used for forming a solid image is applied to the conveying container is reduced by forming the solid image in the centric part of the recording part. As a result, scratches or scrapes of the conveying container, and reduction in the durability of the conveying container can be prevented better compared to a case where the solid image is formed at the peripheral part of the recording part.

In the present specification, the centric part of the recording part is determined with a region thereof relative to the conveying direction of the conveying container, and a region thereof orthogonal to the conveying direction of the conveying container. As for the region relative to the conveying direction of the conveying container, the lower limit of the centric part of the recording part at the upstream side of the conveying direction is preferably 10 or greater, more preferably 20 or greater, and even more preferably 40 or greater, when the edge position of the recording part at the upstream side of the conveying direction is determined as 0, and the edge position of the recording part at the downstream side of the conveying direction is determined as 100. The upper limit of the centric part of the recording part at the downstream side of the conveying direction is preferably 90 or less, more preferably 80 or less, and even more preferably 60 or less. As for the region orthogonal to the conveying direction of the conveying container, moreover, the lower limit of the centric part of the recording part at the upstream side of the conveying direction is preferably 10 or greater, more preferably 20 or greater, and even more preferably 40 or greater, when the edge position of the recording part close to the conveyor line is determined as 0, and the edge position of the recording part far from the conveyor line is determined as 100. The upper limit of the centric part of the recording part at the downstream side of the conveying direction is preferably 90 or less, more preferably 80 or less, and even more preferably 60 or less.

In the case where the conveyor line system of the present invention stops the conveying container at a predetermined position in front of reaching the image processing device using a stopper, it is preferred that the absorbance of the conveying container be smaller than the absorbance of the recording part at the wavelength of laser light for irradiation.

In the conveyor line system, irradiation of laser light may be performed without stopping the conveying container in from of the image processing device. If irradiation of laser light is performed without stopping the conveying container, however, an image quality of an image formed on the recording part may become low due to vibrations of the conveyor line system. Therefore, irradiation of laser light is preferably performed with stopping the conveying container in front of the image processing device.

As for a method for stopping the conveying container in front of the image processing device, there is a method where the conveying container is stopped without using a stopper. However, the conveying container is preferably stopped with a stopper, because the conveying container may slide to cause misregistration, when the conveyor line is stopped.

The stopper is a member configured to stop the conveying container at a predetermined position in front of the image processing device. A material constituting the stopper is appropriately selected, but it is preferably a material having low absorbance at the wavelength of laser light used for irradiation.

The stopper may be a movable stopper or a fixed stopper, and the stopper is appropriately selected depending on the intended purpose. The fixed stopper requires a modification, for example, by providing a system for going over the stopper after completing the image processing, or changing the conveying direction of the conveyor line before or after stopping the conveying container. Therefore, the stopper is preferable a movable stopper, which operates to stop the conveying container on the conveyor line only when the conveying container approaches to the stopping position of the conveying container.

In the case where the conveying container is stopped with the stopper, some problems may occur, such as the conveying container may go beyond the stopper because of its excess force, and the conveying container slides in the opposite direction to the conveying direction due to an impact caused by bumping into the stopper with the excessive traveling force of the conveying container, when a conveying speed of the conveying container is increased to realize high throughput. In such case, the misregistration of the conveying container is caused, and laser light is hence applied to the conveying container. This problem is more likely to occur, as the throughput is greater.

When the conveyor line system configured to stop the conveying container in front of the image processing device with the stopper is used, therefore, scratches or scrapes of the conveying container and the reduction in the durability of the conveying container can be prevented by making the absorbance of the conveying container smaller than the absorbance of the recording part at the wavelength of laser light used for irradiation. In the case where the throughput required for the conveyor line system is large, it is preferred that the absorbance of the conveying container be smaller than the absorbance of the recording part, compared to the case where the throughput thereof is small. It is particularly preferred that the absorbance of the conveying container be smaller than the absorbance of the recording part, as the throughput required for the conveyor line system is greater.

Moreover, the degree of misregistration of the conveying container by the stopper varies depending on a material of the stopper, a material of the conveying container, a weight of the conveying container, and a speed of the conveyor line according to the number of the conveying containers processed by the conveyor line per time depending on the conveying performance of the conveyor, the printing processing time, and the erasing processing time. It is preferred that the aforementioned conditions be set so that the degree of the misregistration be small.

Figure 2:
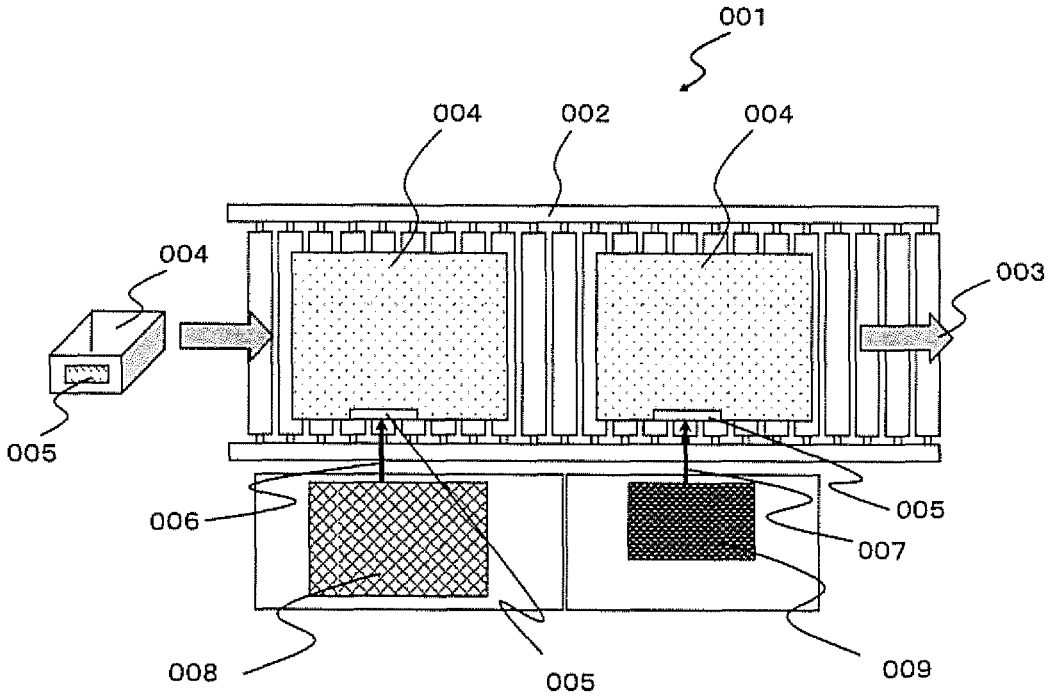
FIG. 2 is a schematic diagram illustrating one example of the conveyor line system.

As for the arrangement of the image processing device, it is preferred that the image erasing device 008, and the image recording device 009 are provided in this order from the upstream of the cover line 002 as illustrated in FIG. 2, and the image erasing device 008 and the image recording device 009 be provided adjacent to each other. In FIG. 2, 001 is a conveyor line system, 003 is a conveying direction of the conveyor line, 004 is a conveying container, 005 is a recording part, 006 is laser light emitted from the image erasing device, and 007 is laser light emitted from the image recording device.

The phrase "adjacent to each other" means a state where the image erasing device and the image recording device are provided as close to each other as possible, provided that the arrangement does not affect image recording or image erasing performed by irradiating the recording part with laser light, does not affect the conveyance of the conveying container moved on the conveyor line, and does not affect an arrangement of a control unit configured to control irradiation laser light based on a detected result of a temperature sensor or a distance sensor, or a power source code, or a wire. It is not necessary that the image erasing device and the image recording device are in contact with each other.

By arranging as illustrated in FIG. 2, a size of a safety cover for preventing laser light from leaking through to the surrounding area can be kept small compared to a case where the image erasing device and the image recording device are provided being apart from each other. Moreover, in the case where a misregistration of the conveying container occurs when an image is recorded on the recording part as in the case described earlier, for example, and a barcode, which is an information reading code, is not accurately recorded to thereby cause a reading error in an information reading device provided at the downstream side of the image recording device, image erasion needs to be performed again on the conveying container passed just before the conveying container, by which the reading error is caused. In the case where the image erasing device and the image recording device are provided adjacent to each other, a number of the conveying containers to which image processing is reperformed can be reduced compared to a case where the image erasing device and the image recording device are provided being apart from each other. Therefore, more images of the recording parts provided to the conveying containers can be rewritten within a short period.

The details of the image processing device, the conveying container, and the recording part, which are suitably used in the present invention, are explained hereinafter.

<Image Processing Device>

The image processing device contains an image recording device and an image erasing device. The image recording device and the image erasing device may be integrated, or mounted as separate bodies.

<<Image Recording Device>>

The image recording device is appropriately selected depending on the intended purpose without any limitation, provided that the image recording device contains an image recording unit using laser light.

The image recording device contains at least a laser light irradiating unit, and may further contain appropriately selected other members, as necessary.

In the present invention, a wavelength of the output laser light is selected so that a recording part, to which an image is formed, absorbs the laser light at high efficiency. For example, in the case where a thermoreversible recording medium is used as the recording part, the thermoreversible recording medium contains at least a photothermal converting material, which has a function of absorbing laser light at high efficiency to generate heat. Therefore, a wavelength of the laser light emitted is selected so that the photothermal converting material as contained absorbs the laser light at the highest efficiency, compared to other materials.

—Laser Light Irradiating Unit—

The laser light irradiating unit is appropriately selected depending on the intended purpose. Examples thereof include a semiconductor laser, solid laser, and fiber laser. Among them, the semiconductor laser is particularly preferable, as it was a wide selectability of wavelengths, and a laser light source thereof is small, which can realize downsizing of a device, and low cost.

The wavelength of the semiconductor laser light, solid laser light, or fiber laser light emitted from the laser light irradiating unit is preferably 700 nm or greater, more preferably 720 nm or greater, and even more preferably 750 nm or greater. The upper limit of the wavelength of the laser light is appropriately selected depending on the intended purpose, but the upper limit thereof is preferably 1,600 nm or shorter, more preferably 1,300 mm or shorter, and particularly preferably 1,200 nm or shorter.

When the wavelength of the laser light is shorter than 700 nm, in the case where a thermoreversible recording medium is used as the recording part, a contrast reduces in the visible ray range during an image recording of the thermoreversible recording medium, or the thermoreversible recording medium may be tinted. In the UV ray range, which is further shorter wavelengths, there is a problem that the thermoreversible recording medium tends to be deteriorated. Moreover, the photothermal converting material added to the thermoreversible recording medium needs to have high decomposition temperature in order to secure a resistance to repetitively performed image processing. In the case where an organic dye is used as the photothermal converting material, it is difficult to obtain the photothermal converting material having high decomposition temperature and long absorption wavelengths. From the reasons as mentioned, the wavelength of the laser light is preferably 1,600 nm or shorter.

The output of the laser light emitted in the image recording step by the image recording device is appropriately selected depending on the intended purpose without any limitation, but the output thereof is preferably 1 W or greater, more preferably 3 W or greater, and particularly preferably 5 W or greater. When the output of the laser light is less than 1 W, it takes a long time to record an image, and the output is insufficient, as it is attempted to reduce the recording time of an image.

Moreover, the upper limit of the output of the laser light is appropriately selected depending on the intended purpose without any limitation, but the upper limit thereof is preferably 200 W or lower, more preferably 150 W or lower, and particularly preferably 100 W or lower. When the upper limit of the output of the laser light is greater than 200 W, a scale of the laser device becomes large.

The scanning speed of the laser applied during the image recording step is appropriately selected depending on the intended purpose without any limitation, but the scanning speed thereof is preferably 100 mm/s or greater, more preferably 300 minis or greater, and particularly preferably 500 mm/s or greater. When the scanning speed is less than 100 mm/s, it takes a long time to record an image.

Moreover, the upper limit of the scanning speed of the laser light is appropriately selected depending on the intended purpose without any limitation, but the upper limit thereof is preferably 15,000 mm/s or less, more preferably 10,000 mm/s or less, and particularly preferably 8,000 mm/s or less. When the scanning speed is greater than 15,000 mm/s, it is difficult to form a uniform image.

The spot diameter of the laser light applied in the image recording step is appropriately selected depending on the intended purpose without any limitation, but the spot diameter thereof is preferably 0.02 mm or greater, more preferably 0.1 mm or greater, and particularly preferably 0.15 mm or greater. When the spot diameter thereof is less than 0.02 mm, a line width of an image becomes narrow, and thus visibility of the image is low.

Moreover, the upper limit of the spot diameter of the laser light is appropriately selected depending on the intended purpose without any limitation, but the upper limit thereof is preferably 3.0 mm or less, more preferably 2.5 mm or less, and particularly preferably 2.0 mm or less. When the spot diameter is greater than 3.0 mm, a line width of an image becomes great, so that adjacent lines are overlapped. Therefore, it becomes impossible to record an image of a small size.

Other factors of the image recording device are not particularly limited, and those described in the present invention, and factors known in the art can be applied.

Figure 3:
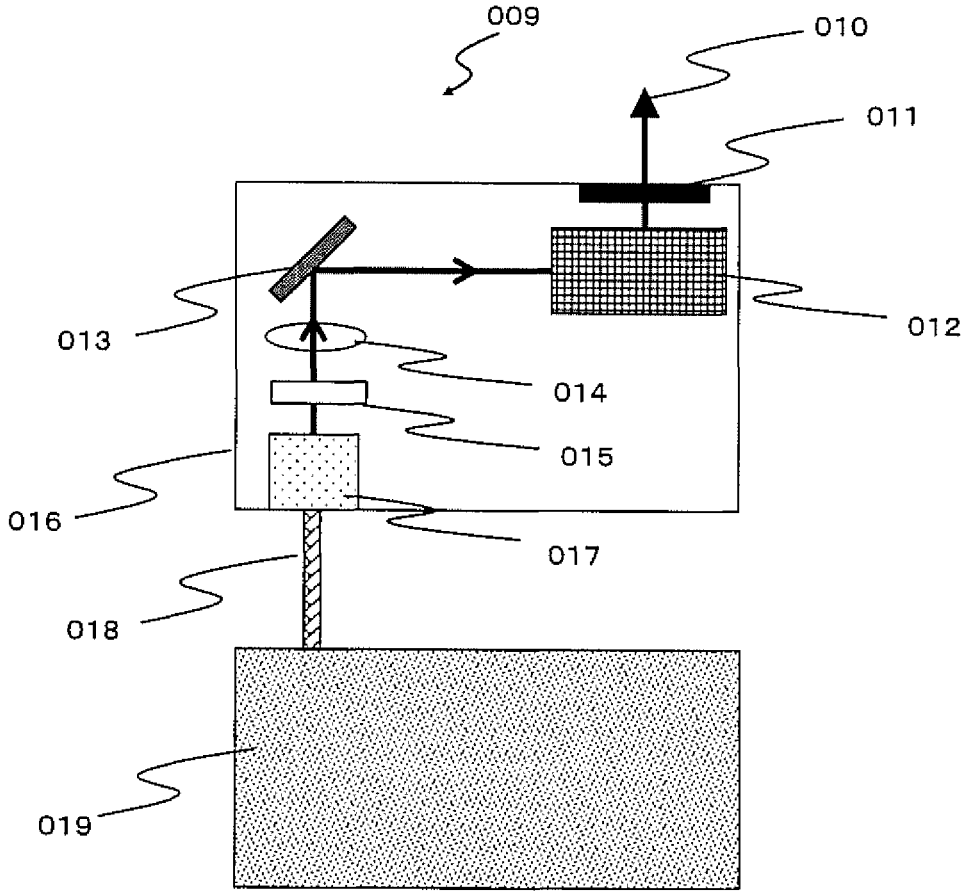
FIG. 3 is a diagram explaining one example of the image recording device.

FIG. 3 is a schematic diagram illustrating one example of the image recording device 009. In this device, a fiber-coupled LD composed of a LD array composed of a plurality of LD light sources, and a special optical lens system, or optic fibers for converting a linear beam emitted from the LD array into a circular beam is used. Use of the fiber-coupled LD enables to irradiate a small circular beam at high output, and print a small character with a fine line at high speed.

As the fiber-coupled LD is used, a controlling unit containing a LD light source, a power source system, or a control system, and an optical head containing a galvanometer mirror unit 012 for scanning laser light on the thermoreversible recording medium at high speed can be provided being apart from each other.

As for the position of the outlet of the optical head, it is necessary to extend a light path as long as possible in order to reduce a beam diameter of laser light applied to the galvanometer mirror unit 012. This is because the galvanometer mirror needs to be large, as the beam diameter is large. In this case, printing cannot be accurately performed. In order to secure a light path as long as possible without increasing the size of the optical head, therefore, the outlet 011 of the laser light is provided at the edge of the optical head, as well as using a reflective mirror 013.

Note that, in FIG. 3, 010 is laser irradiation light of the image recording device, 014 is a condenser lens, 015 is a focal point position correcting unit, 016 is a housing of the optical head of the image recording device, 017 is a collimator lens unit, 018 is an optic fiber, and 019 is a controlling unit of the image recording device.

<<Image Erasing Device>>

In the case where a thermoreversible recording medium is used as the recording part, the device for heating the thermoreversible recording medium to erase the image is appropriately selected depending on the intended purpose without any limitation, and examples thereof include: a non-contact heating device using laser light, hot air, warm water, or an IR heater, and a contact heating device using a thermal head, a hot stamp, a heat block, or a heat roller. Among them, a device using a system where the thermoreversible recording medium is irradiated with laser light is particularly preferable.

The laser light irradiating unit is appropriately selected depending on the intended purpose without any limitation, and examples thereof include a semiconductor laser, a solid laser, a fiber laser, and a $CO_2$ laser. Among them, the semiconductor laser is particularly preferable, as it was a wide selectability of wavelengths, and a laser light source thereof is small, which can realize down-sizing of a device, and low cost.

In order to uniformly erase the image within a short period, the image erasing device more contains the semiconductor laser array, a width-direction collimating unit, and a length-direction light distribution controlling unit, preferably further contains a beam size adjusting unit, and a scanning unit, and more preferably further contain other units, as necessary.

As for one example of the image erasing device, the image erasing device containing at least a semiconductor laser array, a width-direction collimating unit, and a length-direction light distribution controlling unit is explained hereinafter.

With the image erasing device, an image recorded on the thermoreversible recording medium is erased by applying a linear beam, which is longer than the length of the light source of the semiconductor laser array, and has a uniform light distribution in the length direction, to the thermoreversible recording medium a color tone of which is reversibly changes depending on the temperature thereof, to thereby heat the thermoreversible recording medium.

The image erasing method contains at least a width-direction collimating step, and a length-direction light distribution controlling step, and may further contain a beam-size adjusting step, a scanning step, and other steps, as necessary. The image erasing method is a method where an image recorded on a thermoreversible recording medium is erased by applying a linear beam, which is longer than the length of the light source of the semiconductor laser array and has a uniform light distribution in the length direction thereof, to the thermoreversible recording medium, a color tone of which reversibly changes depending on temperature, to thereby heat the thermoreversible recording medium.

The image erasing method is suitably performed by the image erasing device. The width-direction collimating step is suitably performed by the width-direction collimating unit, the length-direction light distribution controlling step is suitably performed by the length-direction light distribution controlling unit, the beam-size adjusting step is suitably performed by the beam-size adjusting unit, the scanning step is suitably performed by the scanning unit, and the aforementioned other steps are suitably performed by the aforementioned other units.

—Semiconductor Laser Array—

The semiconductor laser array is a semiconductor laser light source, in which pluralities of semiconductor lasers are linearly aligned. The semiconductor laser array preferably contains 3 to 300 semiconductor lasers, more preferably 10 to 100 semiconductor lasers.

When the number of the semiconductor lasers contained is small, it may not be able to increase the irradiation power. When the number thereof is large, it may be necessary to provide a large scale cooling device for cooling the semiconductor laser array. Note that, the semiconductor lasers are heated to emit light from the semiconductor laser array, and then it is necessary to cool the semiconductor laser array. Therefore, a cost for the device may increase.

A length of the light source of the semiconductor laser array is appropriately selected depending on the intended purpose without any limitation, but the length thereof is preferably 1 mm to 50 mm, more preferably 3 mm to 15 mm. When the length of the light source of the semiconductor laser array is less than 1 mm, the irradiation power cannot be increased. When the length thereof is greater than 30 mm, a large scale cooling device is required for cooling the semiconductor laser array, which increases a cost of the device.

A wavelength of the laser light emitted from the semiconductor laser array is preferably 700 nm or greater, more preferably 720 nm or greater, and even more preferably 750 nm or greater. The upper limit of the wavelength of the laser light is appropriately selected depending on the intended purpose, but the upper limit thereof is preferably 1,600 nm or shorter, more preferably 1,300 mm or shorter, and even more preferably 1,200 nm or shorter.

When the wavelength of the laser light is shorter than 700 nm, in the case where a thermoreversible recording medium is used as the recording part, a contrast is reduced or the thermoreversible recording medium is tinted, when an image is recorded on the thermoreversible recording medium with the laser light in the visible ray range. With the laser light in the UV ray range, which is shorter than the visible ray range, the thermoreversible recording medium tends to deteriorate. Moreover, the photothermal converting material added to the thermoreversible recording medium needs to have high decomposition temperature in order to secure a resistance to repetitively performed image processing. In the case where an organic dye is used as the photothermal converting material, it is difficult to obtain the photothermal converting material having high decomposition temperature and long absorption wavelengths. From the reasons mentioned above, the wavelength of the laser light is preferably 1,600 nm or shorter.

—Width-Direction Collimating Step and Width-Direction Collimating Unit—

The width-direction collimating step is a step containing collimating a width-direction spread of the laser light emitted from the semiconductor laser array, in which the pluralities of the semiconductor lasers are linearly aligned, to thereby transform into a linear beam, and is performed by the width-direction collimating unit.

The width-direction collimating unit is appropriately selected depending on the intended purpose without any limitation. Examples thereof include a plane-convex cylindrical lens, and a combination of pluralities of convex cylindrical lens.

The laser light emitted from the semiconductor laser array has the larger beam divergence angle in the width direction than that in the length direction. As the width-direction collimating unit is provided adjacent to the output surface of the semiconductor laser array, the beam width is prevented from being wide, and the small size lens can be used. Therefore, such arrangement is preferable.

—Length-Direction Light Distribution Controlling Step and Length-Direction Light Distribution Controlling Unit—

The length-direction light distribution controlling step is a step containing making the linear beam formed in the width-direction collimating step longer than the length of the light source of the semiconductor laser array, and giving a uniform light distribution in the length direction. The length-direction light distribution controlling step can be performed by the length-direction light distribution controlling unit.

The length-direction light distribution controlling unit is appropriately selected depending on the intended purpose without any limitation. For example, the length-direction light distribution controlling unit is composed of a combination of two spherical lenses, an aspherical cylindrical lens (length direction), and a cylindrical lens (width direction). Examples of the aspherical cylindrical lens (length direction) include the Fresnel lens, a convex lens array, and a concave array.

The light distribution controlling unit is provided at the outlet side of the collimating unit.

—Beam-Size Adjusting Step and Beam-Size Adjusting Unit—

In the case where a thermoreversible recording medium is used as the recording part, for example, the beam-size adjusting step is a step containing adjusting the length, or the width, or both of the linear beam, which is longer than the length of the light source of the semiconductor laser array, and has a uniform light distribution in the length direction, on the thermoreversible recording medium. The beam-size adjusting step can be performed by the beam-size adjusting unit.

The beam-size adjusting unit is appropriately selected depending on the intended purpose without any limitation. Examples thereof include a unit configured to change a focal length of the cylindrical lens, or the spherical lens, a unit configured to change a position of the lens, and a unit configured to a work distance between the device and the thermoreversible recording medium.

The length of the linear beam after the adjustment is preferably 10 mm to 300 mm, more preferably 30 mm to 160 mm. As an erasable region is determined by the length of the beam, the erasable region is small when the length is short. When the length of the linear beam is long, on the other hand, energy is applied to a region that does not need to be erased, and thus energy loss may occur, or damage may be caused.

The length of the beam is preferably 2 times or greater the length of the light source of the semiconductor laser array, more preferably 3 times or greater. When the length of the beam is shorter than the length of the light source of the semiconductor laser array, it is necessary to make the light source of the semiconductor laser array long in order to secure a long erasion region, which may increase a cost or size of the device.

Moreover, the width of the linear beam after the adjustment is preferably 0.1 mm to 10 mm, more preferably 0.2 mm to 5 mm. The beam width can control the duration for heating the thermoreversible recording medium. When the beam width is narrow, the heating duration is short, which may reduce eras ability. When the beam width is wide, the heating duration is long, which may apply excess energy to the thermoreversible recording medium, and require high energy to perform erasion at high speed. Therefore, the device desirably adjusts the beam width suitable for the erasion properties of the thermoreversible recording medium.

The output of the linear beam adjusted in the aforementioned manner is appropriately selected depending on the intended purpose without any limitation, but the output thereof is preferably 10 W or greater, more preferably 20 W or greater, and even more preferably 40 W or greater. When the output of the linear beam is less than 10 W, it may take a long time to erase an image. When it is attempted to shorten the image erasion time, the output is insufficient and an erasion failure of the image may occur. Moreover, the upper limit of the output of the laser light is appropriately selected depending on the intended purpose without any limitation, but the upper limit thereof is preferably 500 W or less, more preferably 200 W or less, and even more preferably 120 W or less. When the output of the laser light is greater than 500 W, a cooling device for the light source of the semiconductor laser may need to be large.

—Scanning Step and Scanning Unit—

In the case where a thermoreversible recording medium is used as the recording part, for example, the scanning step is a step containing scanning the linear beam, which is longer than the length of the light source of the semiconductor laser array, and has a uniform light distribution in the length direction, on the thermoreversible recording medium along a monoaxial direction. The scanning step can be performed by the scanning unit.

The scanning unit is appropriately selected depending on the intended purpose without any limitation, provided that it can scan the linear beam along a monoaxial direction, and examples thereof include a monoaxial galvanometer mirror, a polygon mirror, and a stepping motor mirror.

The monoaxial galvanometer mirror and the stepping motor mirror can precisely control the speed, and the polygon mirror is inexpensive though it is difficult to adjust the speed.

The scanning speed of the linear beam is appropriately selected depending on the intended purpose without any limitation, but the scanning speed thereof is preferably 2 minis or greater, more preferably 10 mm/s or greater, and even more preferably 20 mm/s or greater. When the scanning speed is less than 2 mm/s, it may take a long time to erase an image. Moreover, the upper limit of the scanning speed of the laser light is appropriately selected depending on the intended purpose without any limitation, but the upper limit thereof is preferably 1,000 min/s or less, more preferably 300 mm/s or less, and even more preferably 100 mm/s or less. When the scanning speed is greater than 1,000 mm/s, it is difficult to uniformly erase an image.

Moreover, it is preferred that an image recorded on the thermoreversible recording medium be erased by moving the thermoreversible recording medium relative to the linear beam, which is longer than the length of the light source of the semiconductor laser array, and has a uniform light distribution in the length direction, by means of a moving unit, to thereby scan the linear beam on the thermoreversible recording medium.

Examples of the moving unit include a conveyor, and a stage. In this case, it is preferred that the thermoreversible recording medium be attached to a surface of a box, and be moved by moving the box by the conveyor.

—Other Steps and Other Units—

The aforementioned other steps are appropriately selected depending on the intended purpose without any limitation, and examples thereof include a controlling step.

The aforementioned other units are appropriately selected depending on the intended purpose without any limitation, and examples thereof include a controlling unit.

The controlling step is a step containing controlling each step, and is suitably carried out by the controlling unit.

The controlling unit is appropriately selected depending on the intended purpose without any limitation, provided that it can control the movements of each member. Examples thereof include a device, such as a sequencer, and a computer.

Other factors of the image erasing device are not particularly limited, and the factors explained in the present invention, and factors known in the art can be applied.

Figure 4:
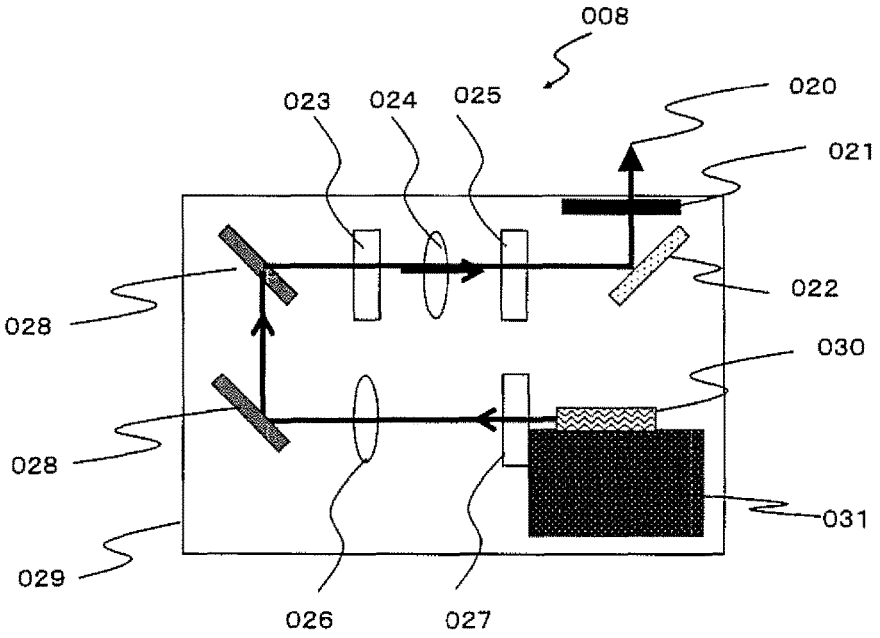
FIG. 4 is a diagram explaining one example of the image erasing device.

FIG. 4 illustrates one example of the image erasing device 008 containing at least the semiconductor laser array 030, the width-direction collimating unit 027, and the length-direction light distribution controlling unit 02G.

The image erasing device 008 contains the width-direction collimating unit 027, the length-direction light distribution controlling unit 026, the beam-width adjusting units 023, 024, 025, and a scanning mirror 022 serving as the scanning unit. Therefore, a long light path is required. In order to secure as a long light path as possible without increasing the size of the image erasing device, therefore, the outlet 021 of the laser light is provided at the end part of the image erasing device, as well as providing a light path in the "C" shape using the reflective mirrors 028.

Note that, in FIG. 4, 020 is laser irradiation light of the image erasing device, 029 is a housing of the image erasing device, and 031 is a cooling unit.

<Recording Part>

The recording part is a region where an image is formed by laser light irradiation, and is appropriately selected depending on the intended purpose without any limitation. Examples of the recording part include a thermoreversible recording medium, an irreversible thermosensitive recording medium, and a recording ink. Among them, a thermoreversible recording medium, to which image recording can be repeatedly performed, is particularly preferable.

<<Thermoreversible Recording Medium>>

The thermoreversible recording medium contains a support; and a thermoreversible recording layer on the support, and may further contain appropriately selected other layers, such as a photothermal conversion layer, a first oxygen barrier layer, a second oxygen barrier layer, a UV ray absorbing layer, a back layer, a protective layer, an intermediate layer, an undercoat layer, an adhesive layer, a bonding agent layer, a coloring layer, an air layer, and a light reflective layer, as necessary. Each of these layers may have a single layer structure, or a laminate structure.

Note that, the photothermal converting material may be contained in the thermoreversible recording layer, or in a layer provided adjacent to the thermoreversible recording layer. In the case where the photothermal converting material is contained in the thermoreversible recording layer, the thermoreversible recording layer also serves as the photothermal conversion layer. As for a layer provided on the photothermal conversion layer, it is preferred that the layer be composed of a material that hardly absorb light of the predetermined wavelength, in order to reduce energy loss of the laser light having the predetermined wavelength for irradiation.

—Support—

A shape, structure, and size of the support are appropriately selected depending on the intended purpose without any limitation. Examples of the shape thereof include a plate shape. The structure thereof may be a single layer structure or a laminate structure. The size thereof is appropriately selected depending on the size of the thermoreversible recording medium.

—Thermoreversible Recording Layer—

The thermoreversible recording layer contains a leuco dye, which is an electron-donating coloring compound, and a color developer, which is an electron accepting compound, and is a thermoreversible recording layer configured to reversibly change a color tone thereof upon application of heat. The thermoreversible recording layer further contains a binder resin, and may further contain other components, as necessary.

The leuco dye, which is an electron donating coloring compound that changes its color tone thereof upon application of heat, and the reversible color developer, which is an electron accepting compound, are materials, which can realize reversible visual changes according to changes in temperature. The leuco dye and the color developer can change between a colored state and an erased state according to a difference between the heating temperature, and the cooling speed after the heating.

—Leuco Dye—

The leuco dye itself is a colorless or pale dye precursor. The leuco dye is appropriately selected from those known in the art without any limitation. Suitable examples thereof include a triphenylmethane phthalide-based leuco compound, a triallyl methane-based leuco compound, a fluoran-based leuco compound, a phenothiazine-based leuco compound, a thiofluoran-based leuco compound, a xanthene-based leuco compound, an indophthalyl-based leuco compound, a spiropyran-based leuco compound, an azaphthalide-based leuco compound, a couromemopyrazole-based leuco compound, a methine-based leuco compound, a Rhodamine anilinolactam-based leuco compound, a Rhodamine lactam-based leuco compound, a quinazoline-based leuco compound, a diazaxanthene-based leuco compound, and a bislactone-based leuco compound. Among them, a fluoran-based leuco dye or a phthalide-based leuco dye is particularly preferable, because they have excellent coloring-erasing properties, color, and preservation properties.

—Reversible Color Developer—

The reversible color developer is appropriately selected depending on the intended purpose without any limitation, provided that it can reversibly color and discharge using heat as a factor. Suitable examples thereof include a compound containing (1) a structure having an ability of coloring the leuco dye (e.g., a phenolic hydroxyl group, a carboxylic acid group, and a phosphoric acid group), or (2) a structure for controlling aggregation force between molecules (e.g., a structure linked with a long-chain hydrocarbon group), or both in a molecule thereof. Note that, the linking part may contain a bivalent or higher linking group containing a hetero atom, and the ling-chain hydrocarbon group may contain the same linking group, or an aromatic group, or both.

As for the (1) structure having an ability of coloring the leuco dye, phenol is particularly preferable.

As for the (2) structure for controlling aggregation force between molecules, a C8 or greater long-chain hydrocarbon group is preferable, a C11 or greater long-chain hydrocarbon group is more preferable. Moreover, the upper limit of the number of carbon atoms is preferably 40 or less, more preferably 30 or less.

The electron-accepting compound (color developer) is preferably used in combination with a compound containing at a —NHCO— group, or a —OCONH— group, or both in a molecule thereof as an erasion accelerator. Use of these compounds in combination can induce an intermolecular interaction between the erasion accelerator and the color developer in the process for forming an erased state, to thereby improve coloring and erasing properties.

The erasion accelerator is appropriately selected depending on the intended purpose without any limitation.

The thermoreversible recording layer may further contain a binder resin, and various additives for improving or controlling the coatability of the thermoreversible recording layer, or coloring and erasing properties, as necessary. Examples of the additives include a surfactant, a conducting agent, filler, an antioxidant, a photostabilizer, a coloring stabilizer, and an erasion accelerator.

—Binder Resin—

The binder resin is appropriately selected depending on the intended purpose without any limitation, provided that it can bind the thermoreversible recording layer on the support. One, or two or more selected from resins known in the art can be used alone or in combination, as the binder resin. Among them, a resin curable by heat, UV rays, or electron beams is preferable in view of an improvement in durability for repetitive use, and a thermosetting resin using an isocyanate-based compound as a crosslinking agent is particularly preferable.

—Photothermal Conversion Layer—

The photothermal conversion layer contains at least a photothermal converting material, which has a function of highly efficiently absorbing the laser light to generate heat. The photothermal converting material may be contained in either of the thermoreversible recording layer, or a layer adjacent to the thermoreversible recording layer, or both. In the case where the photothermal converting material is contained in the thermoreversible recording layer, the thermoreversible recording layer also functions as the photothermal conversion layer. Moreover, a barrier layer may be formed between the thermoreversible recording layer and the photothermal conversion layer for the purpose of preventing an interaction between the thermoreversible recording layer and the photothermal conversion layer. The barrier layer is preferably a layer composed of a material having excellent heat conduction. A layer provided between and sandwiched with the thermoreversible recording layer and the photothermal conversion layer is appropriately selected depending on the intended purpose, and is not limited those mentioned above.

The photothermal converting material is roughly classified into an inorganic material, and an organic material.

The inorganic material is not particularly limited, and examples thereof include: carbon black; a metal (e.g., Ge, Bi, In, Te, Se, and Cr), or a semimetal; an alloy thereof; metal boride particles; and metal oxide particles.

As for the metal boride and the metal oxide, for example, hexaboride, a tungsten oxide compound, antimony-doped tin oxide (ATO), tin-doped indium oxide (ITO), and zinc antimonate.

The organic material is not particularly limited, and various dyes can be appropriately used as the organic material depending on a wavelength of light to be absorbed. In the case where a semiconductor laser is used as a light source, a near infrared-absorbing dye having an absorption peak in the wavelength range of 700 nm to 1,600 nm is used. Specific examples thereof include a cyanine dye, a quinine-based dye, a quinoline derivative of indonaphthol, a phenylene diamine-based nickel complex, and a phthalocyanine-based compound. In order to perform the image processing repeatedly, a photothermal converting material having excellent heat resistance is preferably selected. In this point of view, a phthalocyanine-based compound is particularly preferable as the photothermal converting material.

The near infrared-absorbing dye may be used alone, or in combination.

In the case where the photothermal conversion layer is provided, the photothermal converting material is typically used in combination with a resin. The resin used for the photothermal conversion layer can be appropriately selected from resins known in the art without any limitation, provided that the resin can hold the inorganic material or the organic material. As for the resin, a thermoplastic resin, or a thermosetting resin is preferable. Those usable as a binder resin in the recording layer can be suitably used. Among them, a resin curable by heat, UV rays, or electron beams is preferable in view of an improvement in durability for repetitive use, and a thermal crosslinking resin using an isocyanate-based compound as a crosslinking agent is particularly preferable.

—First and Second Oxygen Barrier Layers—

The first and second oxygen barrier layers are preferably respectively provided on top and bottom surfaces of the thermoreversible recording layer for the purpose of preventing oxygen from entering the thermoreversible recording layer to thereby prevent photodeterioration of the leuco dye in the thermoreversible recording layer. A first oxygen barrier layer may be provided on a surface of the support where the thermoreversible recording layer is not provided, and a second oxygen barrier layer may be provided on the thermoreversible recording layer. Alternatively, a first oxygen barrier layer may be provided between the support and the thermoreversible recording layer, and a second oxygen barrier layer may be provided on the thermoreversible recording layer.

—Protective Layer—

The thermoreversible recording medium for use in the present invention preferably contains a protective layer provided on the thermoreversible recording layer for the purpose of protecting the thermoreversible recording layer. The protective layer is appropriately selected depending on the intended purpose without any limitation, but the protective layer may be provided on one or more layers, and is preferably provided on the outermost surface of the thermoreversible recording medium, which is exposed.

—UV Ray Absorbing Layer—

In the present invention, a UV ray absorbing layer is preferably provided on an a surface of the thermoreversible recording layer, which is opposite to the surface thereof where the support is provided, for the purpose of preventing erasion failure of the leuco dye in the thermoreversible recording layer caused by coloring and photodeterioration by UV rays. The UV ray absorbing layer can improve light resistance of the recording medium. A thickness of the UV ray absorbing layer is appropriately selected so that the UV ray absorbing layer absorbs UV rays of 390 nm or shorter.

—Intermediate Layer—

In the present invention, an intermediate layer is preferably provided between the thermoreversible recording layer and the protective layer for the purpose of improving the adhesion between the thermoreversible recording layer and the protective layer, preventing a deterioration of the thermoreversible recording layer due to the coating of the protective layer, and preventing the additives contained in the thermoreversible recording layer from migrating into the protective layer. The intermediate layer can improve preservation properties of a colored image.

—Under Layer—

In the present invention, an under layer may be provided between the thermoreversible recording layer and the support for the purpose of effectively utilizing the applied heat to increase the sensitivity, improving the adhesion between the support and the thermoreversible recording layer, or preventing permeation of the recording layer material into the support.

The under layer contains at least hollow particles, optionally a binder resin, and may further contain other components, as necessary.

—Back Layer—

In the present invention, a back layer may be provided on a surface of the support, which is opposite to the surface thereof where the thermoreversible recording layer has been provided, for the purpose of preventing curling or charging of the thermoreversible recording medium, and improving conveyance properties of the thermoreversible recording medium.

The back layer contains at least a binder resin, and may further contain other components, such as fillers, conductive fillers, a lubricant, and a color pigment, as necessary.

—Adhesive Layer or Bonding Agent Layer—

In the present invention, an adhesive layer or bonding agent layer may be provided on an opposite surface of the support to the surface thereof where the thermoreversible recording layer has been formed, to thereby use the thermoreversible recording material as a thermoreversible label. As for a material of the adhesive layer or pressure-sensitive adhesive layer, materials that are typically used can be used.

Figure 6:
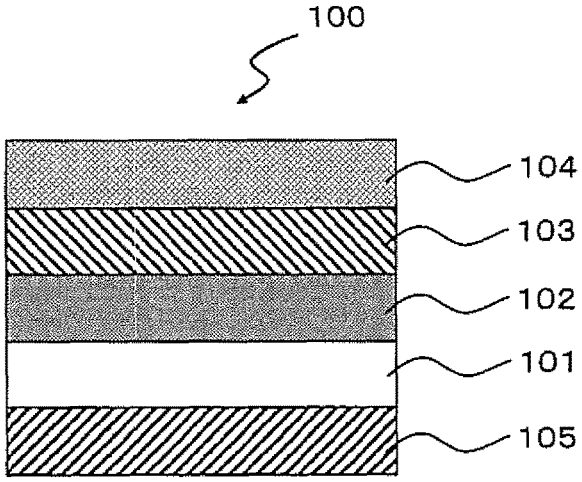
FIG. 6 is a schematic cross-sectional view illustrating one example of a layer structure of a thermoreversible recording medium.

As for a layer structure of the thermoreversible recording medium 100, there is an embodiment, where the thermoreversible recording medium 100 contains a support 101, and a thermoreversible recording layer 102 containing a photothermal converting material, a first oxygen barrier layer 103, and a UV ray absorbing layer 104, provided in this order on the support, and moreover a second oxygen barrier layer 105 provided on a surface of the support 101 where the thermoreversible recording layer is not provided, as illustrated as one example of the layer structure in FIG. 6. Note that, a protective layer may be formed on the outermost surface layer, although it is not illustrated in the drawing.

<Mechanism of Image Recording and Image Erasing>

The mechanism of the image recording and the image erasing is an embodiment where a color tone is reversibly changed by heat. The embodiment uses a leuco dye and a reversible color developer (may be referred as a "color developer" hereinafter), and in this embodiment, the color tone is reversibly changed between a transparent state and a colored state by heat.

Figure 5A:
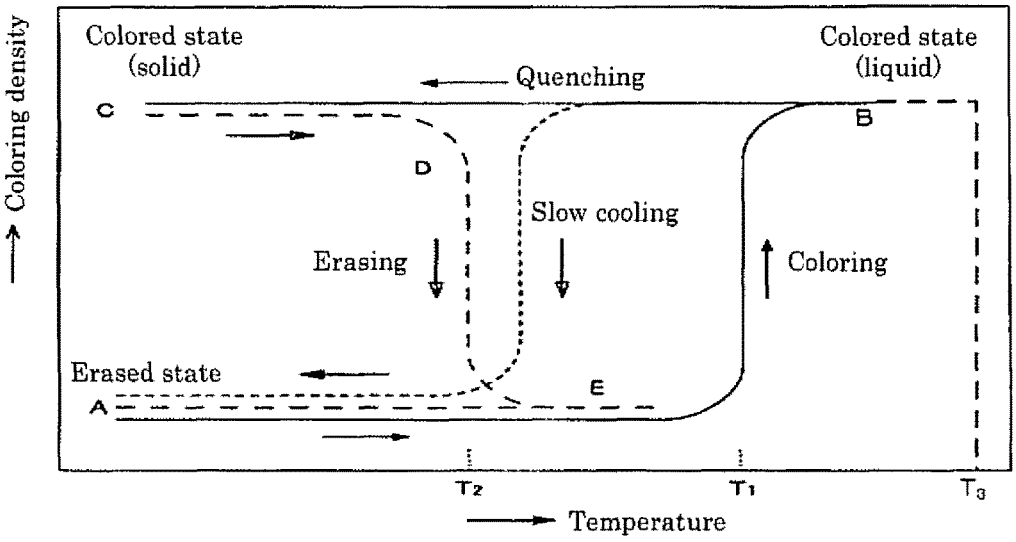
FIG. 5A is a graph depicting coloring-erasing properties of a thermoreversible recording medium.
Figure 5B:
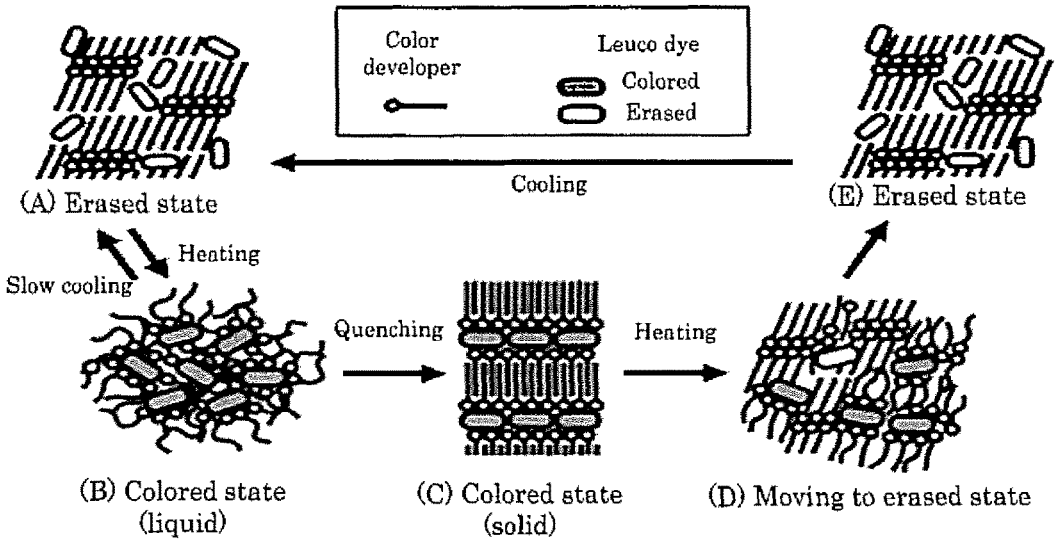
FIG. 5B is a schematic diagram illustrating a mechanism of a coloring-erasing change of a thermoreversible recording medium.

FIG. 5A depicts a temperature-color density variation curve of the thermoreversible recording layer, in which the leuco dye and the color developer are contained in the resin. FIG. 5B illustrates a coloring-erasing mechanism of the thermoreversible recording medium, which reversibly changes between a transparent state and a colored state upon application of heat.

As the recording layer initially in the erased state (A) is heated, first, the leuco dye and the color developer are melted and mixed at the melting temperature $T_1$, to color and turn into a melt colored state (B). As the recording layer in the melt colored state (B) is quenched, the recording layer can be cooled to room temperature with maintaining the colored state, and is turned into the colored state (C) where the colored state is stabilized and fixed. Whether or not this colored state is obtained depends on the cooling speed from the melted state. When the temperature is slowly cooled, the color is erased in the process of cooling, the recording layer is turned into the erased state (A) that is identical to the initial state, or the state where the density is relatively lower than the colored state (C) obtained by quenching. As the recording layer in the colored state (C) is again heated, on the other hand, the color is erased (from D to E) at the temperature $T_2$ lower than the coloring temperature. As the recording layer in this state is cooled, the recording layer is turned back to the erased state (A) that is identical to the initial state.

The colored state (C) obtained by quenching from the melted state is a state where the leuco dye and the color developer are mixed in a manner that molecules thereof can cause a catalytic reaction to each other, and often forms a solid state. In this state, the melt mixture (the colored mixture) of the leuco dye and the color developer is crystallized to maintain the color, and it is considered that the color is stabilized by the formation of this structure. On the other hand, the erased state is a state where the phase separation of the leuco dye and the color developer phase is caused. In this case, at least molecules of one of the compounds are assembled together to form a domain, or crystallized, and a stable state is created by separating the leuco dye and the color developer due to the aggregation or crystallization. In most of cases, more perfect erasion is realized, as the leuco dye and the color developer causes phase separation and the color developer is crystallized.

Note that, the erasion realized by slowly cooling from the melted state, and the erasion realized by heating from the colored state illustrated in FIG. 5A both case phase separation or crystallization of the color developer, as the aggregated structure is changed at $T_2$.

In FIG. 5A, moreover, there is a case where an erasion failure where erasion cannot be carried out even after the recording layer is heated to the erasion temperature may occur, when the recording layer is repeatedly heated to the temperature $T_3$ that is equal to or higher than the melting temperature $T_1$. It is assumed that this is because the color developer is thermally decomposed, and therefore it is difficult to aggregate or crystallize the color developer. As a result, it is difficult to separate the color developer from the leuco dye. In order to prevent the deterioration of the thermoreversible recording medium due to repetitive use, a difference between the melting temperature $T_1$ and the temperature $T_3$ of FIG. 5A is made small, when the thermoreversible recording medium is heated.

Since the conveyor line system of the present invention can prevent scratches or scrapes on the conveying container and reduction in durability of the conveying container caused by repetitive use of the conveying container, the conveyor line system of the present invention is suitably used, for example, for a physical distribution management system, a delivery management system, a storage management system, or a process management system in a factory.

(Conveying Container)

The conveying container for use in the present invention is a conveying container, which contains a recording part to which image recording is performed by laser light irradiation, and is repeatedly used.

At the wavelength of the laser light emitted when the image is recorded on the recording part, the absorbance A of the recording part and the absorbance B of the conveying container satisfy the following formula: A+50>B.

The recording part is preferably the thermoreversible recording medium, as recording and erasing can be repeatedly performed.

A shape, size, material, and structure of the conveying container are appropriately selected depending on the intended purpose without any limitation.

The material of the conveying container is appropriately selected depending on the intended purpose without any limitation, and examples thereof include wood, paper, cardboard, a resin, a metal, and glass. Among them, a resin is preferable in view of formability, durability, and its light weight.

The resin is appropriately selected depending on the intended purpose without any limitation, and examples thereof include a polyethylene resin, a polypropylene resin, a vinyl chloride resin, a polystyrene resin, an AS resin, an ABS resin, a polyethylene terephthalate resin, an acrylic resin, a polyvinyl alcohol resin, a vinylidene chloride resin, a polycarbonate resin, a polyamide resin, an acetal resin, a polybutylene terephthalate resin, a fluororesin, a phenol resin, a melamine resin, a urea resin, a polyurethane resin, an epoxy resin, and an unsaturated polyester resin. They may be used alone, or in combination. Among them, a polypropylene resin is preferable in view of chemical resistance, mechanical strength, and heat resistance.

Specific example of the conveying container include a plastic container, and cardboard box.

In the case where a material used for the conveying container is transparent, a colorant is preferably added. With a transparent conveying container without containing a colorant, the contents in the conveying container may be seen from outside. There is a case where a transparent conveying container is desired. If contents in the conveying container can be seen from outside, invasion of privacy, or leak of information may be however concerned depending on the contents.

—Colorant—

As for the colorant, there are a pigment and a dye. Among them, a pigment having excellent weather resistance is excellent, as a conveying container is repeatedly used in the conveyor line system.

The pigment is appropriately selected depending on the intended purpose without any limitation, and examples thereof include a phthalocyanine-based pigment, an isoindolinone-based pigment, an isoindoline-based pigment, a quinacridone-based pigment, aperylene-based pigment, an azo-pigment, an anthraquinone-based pigment, titanium oxide, cobalt blue, ultramarine, carbon black, iron oxide, cadmium yellow, cadmium red, chrome yellow, and chromium oxide.

As for the conveying container using a resin, for example, the colorant can be kneaded with the resin, when the conveying container is shaped. Moreover, an amount of the colorant contained in the conveying container is appropriately selected depending on the intended purpose. However, it is preferred that an amount of the colorant by which contents in the conveying container cannot be seen from outside be added.

A shaping method of the conveying container using the resin is appropriately selected depending on the intended purpose without any limitation, and examples thereof include extrusion molding, blow molding, vacuum molding, calendar molding, and injection molding.

A surface of the conveying container may be coated with a surface protecting agent for the purpose of preventing scratches formed on the surface, a polishing agent for the purpose of preventing scratches or scrapes, a matting agent, an antifouling agent, or an anti-rust agent for the purpose of improving the external appearance, or processed with surface texturing for the purpose of improving releasing properties of a label.

EXAMPLES

Examples of the present invention are explained hereinafter, but Examples shall not be construed as to limit a scope of the present invention in any way.

Production Example 1

Production of Thermoreversible Recording Medium

A thermoreversible recording medium, a color tone of which was reversibly changed, was produced in the following manner.

—Support—

As for the support, a white polyester film (Tetron (registered trade mark) Film U2L98W, manufactured by Teijin DuPont Films Japan Limited) having the average thickness of 125 μm was provided.

—Under Layer—

An under layer coating liquid was prepared by blending 30 parts by mass of a styrene/butadiene-based copolymer (PA-9159, manufactured by Nippon A&L Inc.), 12 parts by mass of a polyvinyl alcohol resin (POVAL PVA103, manufactured by KURARAY CO., LTD.), 20 parts by mass of hollow particles (Microsphere R-300, manufactured by Matsumoto Yushi-Seiyaku Co., Ltd.), and 40 parts by mass of water, and stirring the mixture for 1 hour until the mixture became homogeneous.

Subsequently, the obtained under layer coating liquid was applied on the support with a wire bar, and the applied coating liquid was heated for 2 minutes at 80° C. to dry, to thereby form an under layer having the average thickness of 20 μm.

—Thermoreversible Recording Layer—

The reversible color developer represented by the following structural formula (1) (5 parts by mass), 0.5 parts by mass of each of the two erasion accelerators respectively represented by the following structural formula (2) and the following chemical formula (3), 10 parts by mass of a 50% by mass acryl polyol solution (hydroxyl value=200 mgKOH/g), and 100 parts by mass of methyl ethyl ketone were ground and dispersed by means of a ball mill until the average particle diameter thereof was to be about 1 μm.

<Structural Formula (1)>

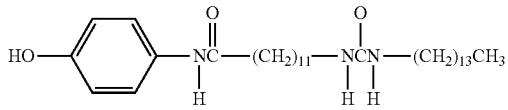

<Structural Formula (2)>

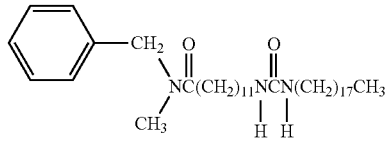

$C_{17}H_{35}CONHC_{18}H_{37}$ <Chemical Formula (3)>

To the dispersion liquid obtained by grinding and dispersing the reversible color developer, 1 part by mass of 2-anilino-3-methyl-6-dimethylaminofluorene serving as a leuco dye, 0.26 parts by mass of a 1.85% by mass $LaB_6$ dispersion liquid (KHF-7A, manufactured by Sumitomo Metal Mining Co., Ltd.) serving as a photothermal converting material, and 5 parts by mass of isocyanate (CORONATE HL, manufactured by Nippon Polyurethane Industry Co., Ltd.) were added. The resulting mixture was sufficiently stirred, to thereby prepare a thermoreversible recording layer coating liquid.

Subsequently, the obtained thermoreversible recording layer coating liquid was applied onto the support using a wire bar. The applied thermoreversible recording layer coating liquid was heated for 2 minutes at 100° C. to dry, followed by curing for 24 hours at 60° C., to thereby form a thermoreversible recording layer having the average thickness of 14.5 μm.

—UV Ray Absorbing Layer—

A UV ray absorbing layer coating liquid was prepared by blending and sufficiently stirring 10 parts by mass of a 40% by mass UV ray absorbing polymer solution (UV-G302, manufactured by Nippon Shokubai Co., Ltd.), 1.0 part by mass of isocyanate (CORONATE HL, manufactured by Nippon Polyurethane Industry Co., Ltd.), and 12 parts by mass of methyl ethyl ketone. Subsequently, the UV ray absorbing layer coating liquid was applied on the thermoreversible recording layer using a wire bar. The applied UV ray absorbing layer coating liquid was heated for 1 minute at 90° C. to dry, followed by heating for 24 hours at 60° C., to thereby form a UV ray absorbing layer having a thickness of 13.5 μm.

—Oxygen Barrier Layer—

An adhesive layer coating liquid was prepared by blending and sufficiently stirring 5 parts by mass of a urethane-based adhesive (TM-567, manufactured by Toyo-Morton, Ltd.), 0.5 parts by mass of isocyanate (CAT-RT-37, manufactured by Toyo-Morton, Ltd.), and 5 parts by mass of ethyl acetate.

Subsequently, the adhesive layer coating liquid was applied on a silica vapor deposited PET film [TB-PET-C, manufactured by Dai Nippon Printing Co., Ltd., oxygen permeation degree: 15 mL/($m^2$·day·MPa)] using a sire bar. The applied adhesive layer coating liquid was heated for 1 minute at 80° C. to dry. The resultant was bonded to the UV ray absorbing layer, followed by heating for 24 hours at 50° C., to thereby form an oxygen barrier layer having the average thickness of 12 μm.

—Bonding Agent Layer—

A composition containing 50 parts by mass of an acryl-based adhesive (BPS-1109, manufactured by TOYO INK CO., LTD.), and 2 parts by mass of isocyanate (D-170N, manufactured by Mitsui Chemicals, Inc.) was sufficiently stirred to thereby prepare a bonding agent layer coating liquid.

Subsequently, the bonding agent layer coating liquid was applied on a surface of the support, which was opposite to the surface thereof where the thermoreversible recording layer had been provided, using a wire bar. The applied bonding agent layer coating liquid was dried for 2 minutes at 90° C., to thereby form a bonding agent layer having a thickness of 20 μm.

In the manner as described above, the thermoreversible recording medium of Production Example 1 was produced.

Next, a reflectance of the thermoreversible recording medium of Production Example 1 was measured by means of an integrating sphere photometer (U-4100, manufactured by Hitachi High-Technologies Corporation). The result is depicted in FIG. 7.

Figure 7:
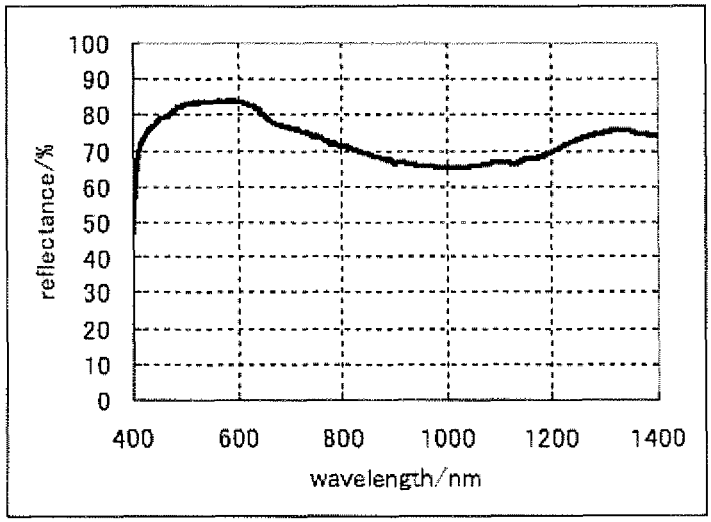
FIG. 7 is a graph illustrating reflection properties of the thermoreversible recording medium of Production Example 1.

It could be read from the result of FIG. 7 that the reflectance thereof at the wavelength of 980 nm (at the time of image recording) was 65.4%, and the reflectance thereof at the wavelength of 976 nm (at the time of image erasing) was 65.5%. Therefore, the absorbance of the thermoreversible recording medium at the wavelength of 980 nm (at the time of image recording) was 34.6%, and the absorbance thereof at the wavelength of 976 nm (at the time of image erasing) was 34.5%.

Subsequently, laser light having a center wavelength of 980 nm was applied on the thermoreversible recording medium, which had been bonded to the conveying container as a recording part, by means of Ricoh Rewritable Laser Marker (LDM200-110, manufactured by Ricoh Company Limited) under the conditions where the output was 20.3 W, the irradiation distance was 150 mm, the spot diameter was 0.48 mm, and the scanning speed was 1,000 mm/s, to thereby record a solid square image having a height of 8.0 mm, and a width of 8.0 mm.

Subsequently, laser light having a center wavelength of 976 nm was applied to the thermoreversible recording medium, to which the image had been recorded, by means of Ricoh Rewritable Laser Eraser (LDE800-A, manufactured by Ricoh Company Limited) under the conditions where the output was 66 W, the irradiation distance was 110 mm, the beam short width was 1.1 mm, and the scanning speed was 10 mm/s, to thereby erase the solid square image.

The image recording and image erasing were repeated 100 times under the aforementioned conditions, and were visually observed. As a result, it was confirmed that recording and erasing of the solid square image could be performed.

In this test, the image processing was performed in the order of the image recording and the image erasing, and was counted as once when the image recording and image erasing were respectively performed once.

Example 1

Figure 8:
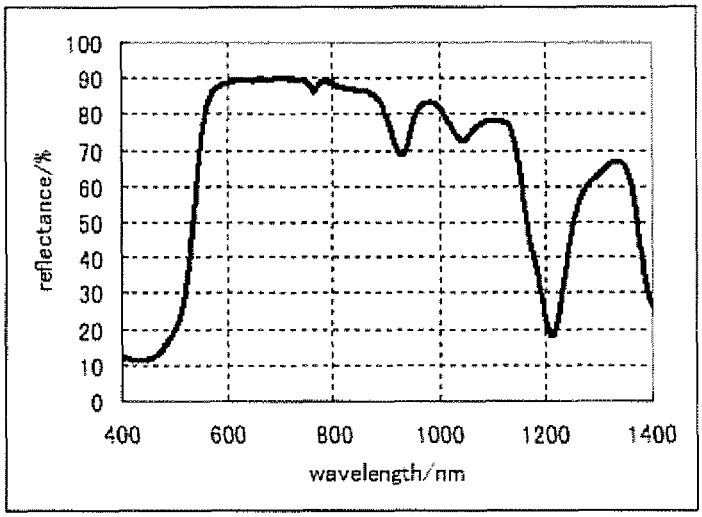
FIG. 8 is a graph depicting reflection properties of the conveying container of Example 1, which is formed of a yellow polypropylene (PP) resin plate.

A reflectance of a conveying container (a cube, W: 40 cm, D: 30 cm, H: 30 cm) formed of a yellow polypropylene propylene(PP) resin plate having a thickness of 2 mm was measured by means of an integrating sphere photometer (U-4100, manufactured by Hitachi High-Technologies Corporation). The results are depicted in FIG. 8 and Table 1-1. With a wavelength (980 nm) of the laser light emitted at the time of the image recording, the absorbance A (34.6%) of the thermoreversible recording medium serving as the recording part and the absorbance B (16.5%) of the conveying container satisfied the following formula A+50>B.

Subsequently, laser light having a center wavelength of 980 nm was applied to the conveying container, to which the thermoreversible recording medium had been bonded as a recording part, by means of Ricoh Rewritable Laser Marker (LDM200-110, manufactured by Ricoh Company Limited) under the conditions where the output was 20.3 W, the irradiation distance of 150 mm, the spot diameter of 0.48 mm, and the scanning speed of 1,000 mm/s, to thereby write a solid square image having a height of 8.0 mm, and a width of 8.0 mm.

Subsequently, laser light having a center wavelength of 976 nm was applied to the conveying container, to which the thermoreversible recording medium had been attached as a recording part, by means of Ricoh Rewritable Laser Eraser (LDE800-A, manufactured by Ricoh Company Limited) under the conditions where the output was 66 W, the irradiation distance was 110 mm, the beam short width was 1.1 mm, and the scanning speed was 10 mm/s.

<Evaluation Method of Repeating Durability>

The irradiation of laser light was repeatedly performed with the aforementioned conditions 10 times. Thereafter, the conveying container was visually observed, but no laser light irradiation mark was observed on the conveying container. Moreover, the irradiation of laser light was performed repeatedly 100 times. Thereafter, the conveying container was visually observed, but no laser light irradiation mark was observed on the conveying container.

In this evaluation method, the repeating time was determined once, when irradiation of laser light by the image recording device and irradiation of laser light by the image erasing device were respectively performed once. The repeating durability was evaluated based on the following evaluation criteria. The results are presented in Table 1-2.

[Evaluation Criteria]

A: No laser light irradiation mark was observed on the conveying container even after the laser light irradiation by the image recording device and the laser light irradiation by the image erasing device were repeated 100 times or more.

B: No laser light irradiation mark was observed on the conveying container even after the laser light irradiation by the image recording device and the laser light irradiation by the image erasing device were repeated 11 times or more but less than 100 times.

C: A laser light irradiation mark was observed on the conveying container, when the laser light irradiation by the image recording device and the laser light irradiation by the image erasing device were repeated 10 times or less.

Example 2

Figure 9:
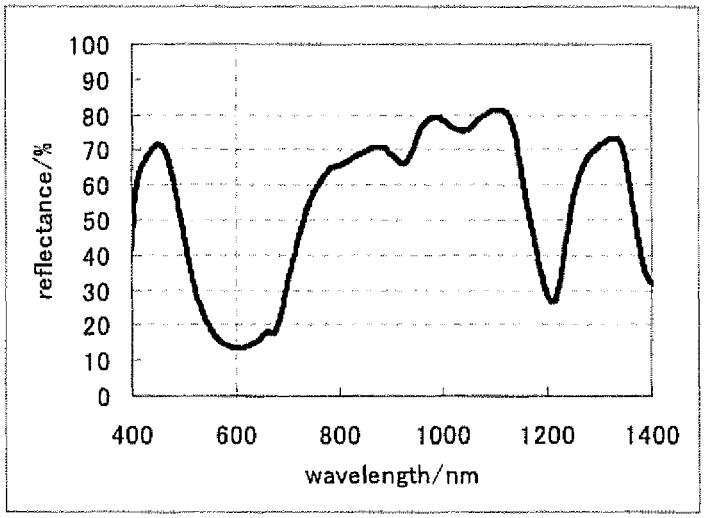
FIG. 9 is a graph depicting reflection properties of the conveying container of Example 2, which is formed of a baby blue polypropylene (PP) resin plate.

The same procedure of Example 1 was repeated, provided that the yellow polypropylene (PP) resin plate having a thickness of 2 mm was replaced with a baby blue polypropylene (PP) resin plate having a thickness of 2 mm. The measurement results of the reflectance are depicted in FIG. 9 and Table 1-1.

With a wavelength (980 nm) of the laser light emitted at the time of the image recording, the absorbance A (34.6%)

of the thermoreversible recording medium serving as the recording part and the absorbance B (20.8%) of the conveying container satisfied the following formula A+50>B.

Subsequently, the evaluation of the repeating durability was performed in the same manner as in Example 1. The irradiation of laser light was performed 10 times with the aforementioned conditions, and then the conveying container was visually observed. As a result, no laser light irradiation mark was observed on the conveying container. Moreover, the irradiation of laser light was performed repeatedly 100 times. Thereafter, the conveying container was visually observed, but no laser light irradiation mark was observed on the conveying container. The results are depicted in Table 1-2.

Example 3

Figure 10:
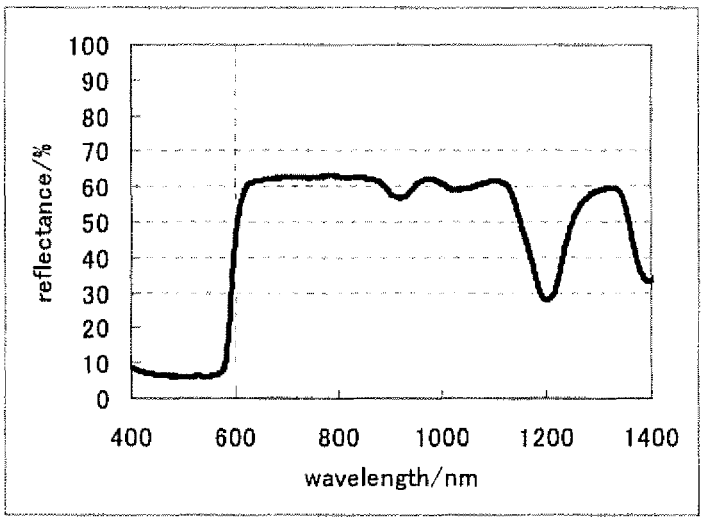
FIG. 10 is a graph depicting reflection properties of the conveying container of Example 3, which is formed of a red polypropylene (PP) resin plate.

The same procedure of Example 1 was repeated, provided that the yellow polypropylene (PP) resin plate having a thickness of 2 mm was replaced with a red polypropylene (PP) resin plate having a thickness of 2 mm. The measurement results of the reflectance are depicted in FIG. 10 and Table 1-1.

With a wavelength (980 nm) of the laser light emitted at the time of the image recording, the absorbance A (34.6%) of the thermoreversible recording medium serving as the recording part and the absorbance B (37.9%) of the conveying container satisfied the following formula A+50>B, but did not satisfy the following formula A>B.

Subsequently, the evaluation of the repeating durability was performed in the same manner as in Example 1. The irradiation of laser light was performed 10 times with the aforementioned conditions, and then the conveying container was visually observed. As a result, no laser light irradiation mark was observed on the conveying container. Moreover, the irradiation of laser light was performed repeatedly 80 times. Thereafter, the conveying container was visually observed. As a result, a laser light irradiation mark was observed on the conveying container. The results are depicted in Table 1-2.

Example 4

Figure 11:
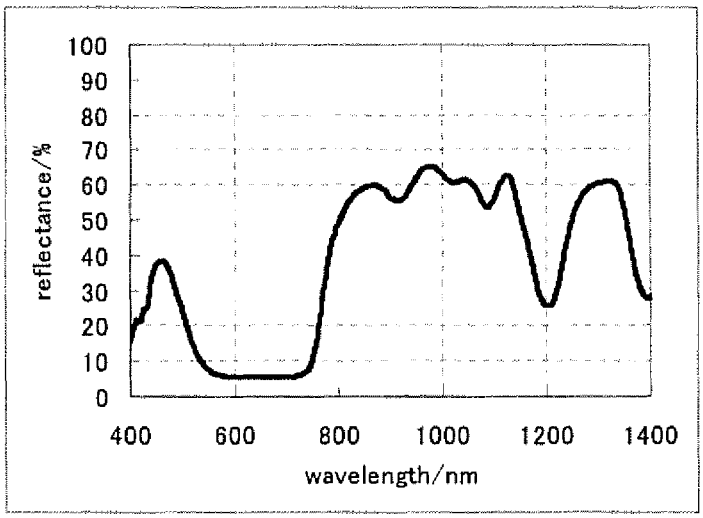
FIG. 11 is a graph depicting reflection properties of the conveying container of Example 4, which is formed of a blue polypropylene (PP) resin plate.

The same procedure of Example 1 was repeated, provided that the yellow polypropylene (PP) resin plate having a thickness of 2 mm was replaced with a blue polypropylene (PP) resin plate having a thickness of 2 mm. The measurement results of the reflectance are depicted in FIG. 11 and Table 1-1.

With a wavelength (980 nm) of the laser light emitted at the time of the image recording, the absorbance A (34.6%) of the thermoreversible recording medium serving as the recording part and the absorbance B (34.9%) of the conveying container satisfied the following formula A+50>B, but did not satisfy the following formula A>B.

Subsequently, the evaluation of the repeating durability was performed in the same manner as in Example 1. The irradiation of laser light was performed 10 times with the aforementioned conditions, and then the conveying container was visually observed. As a result, no laser light irradiation mark was observed on the conveying container. Moreover, the irradiation of laser light was performed repeatedly 80 times. Thereafter, the conveying container was visually observed. As a result, a laser light irradiation mark was observed on the conveying container. The results are depicted in Table 1-2.

Example 5

Figure 12:
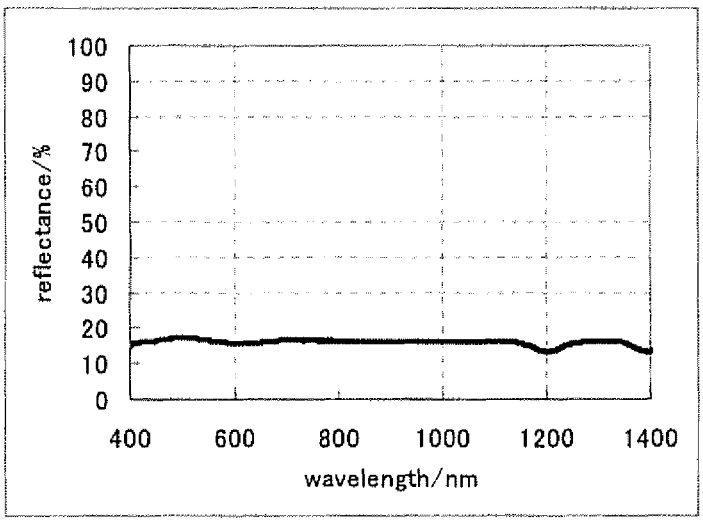
FIG. 12 is a graph depicting reflection properties of the conveying container of Example 5, which is formed of a gray polypropylene (PP) resin plate.

The same procedure of Example 1 was repeated, provided that the yellow polypropylene (PP) resin plate having a thickness of 2 mm was replaced with a gray polypropylene (PP) resin plate having a thickness of 2 mm. The measurement results of the reflectance are depicted in FIG. 12 and Table 1-1.

With a wavelength (980 nm) of the laser light emitted at the time of the image recording, the absorbance A (34.6%) of the thermoreversible recording medium serving as the recording part and the absorbance B (83.7%) of the conveying container satisfied the following formula A+50>B, but did not satisfy the following formula A>B.

Subsequently, the evaluation of the repeating durability was performed in the same manner as in Example 1. The irradiation of laser light was performed 10 times with the aforementioned conditions, and then the conveying container was visually observed. As a result, no laser light irradiation mark was observed on the conveying container. Moreover, the irradiation of laser light was performed repeatedly 40 times. Thereafter, the conveying container was visually observed. As a result, a laser light irradiation mark was observed on the conveying container. The results are depicted in Table 1-2.

Comparative Example 1

Figure 13:
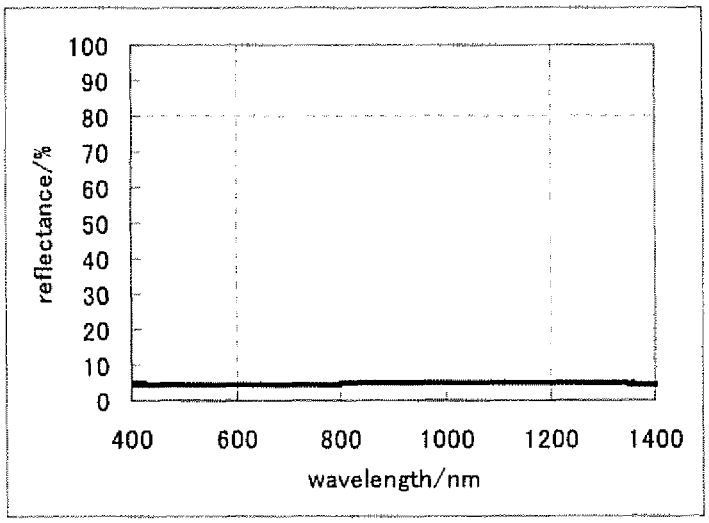
FIG. 13 is a graph depicting reflection properties of the conveying container of Comparative Example 1, which is formed of a black polypropylene (PP) resin plate.

The same procedure of Example 1 was repeated, provided that the yellow polypropylene (PP) resin plate having a thickness of 2 mm was replaced with a black polypropylene (PP) resin plate having a thickness of 2 mm. The measurement results of the reflectance are depicted in FIG. 13 and Table 1-1.

With a wavelength (980 nm) of the laser light emitted at the time of the image recording, the absorbance A (34.6%) of the thermoreversible recording medium serving as the recording part and the absorbance B (95.1%) of the conveying container did not satisfy the following formula A+50>B.

Subsequently, the evaluation of the repeating durability was performed in the same manner as in Example 1. The irradiation of laser light was performed once with the aforementioned conditions, and then the conveying container was visually observed. As a result, a laser light irradiation mark was observed on the conveying container. Moreover, the laser light irradiation mark was touched with a fiber. As a result, a surface texture thereof was rough. The results are depicted in Table 1-2.

Comparative Example 2

Figure 14:
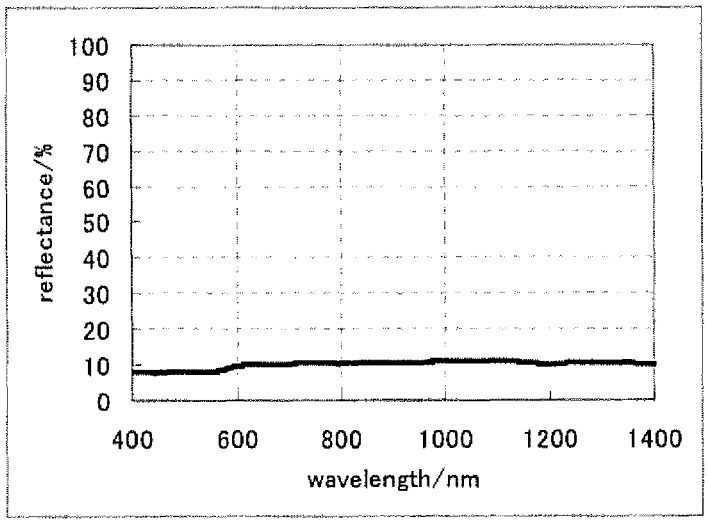
FIG. 14 is a graph depicting reflection properties of the conveying container of Comparative Example 2, which is formed of a brown polypropylene (PP) resin plate.

The same procedure of Example 1 was repeated, provided that the yellow polypropylene (PP) resin plate having a thickness of 2 mm was replaced with a brown polypropylene (PP) resin plate having a thickness of 2 mm. The measurement results of the reflectance are depicted in FIG. 14 and Table 1-1.

With a wavelength (980 nm) of the laser light emitted at the time of the image recording, the absorbance A (34.6%) of the thermoreversible recording medium serving as the recording part and the absorbance B (89.1%) of the conveying container did not satisfy the following formula A+50>B.

Subsequently, the evaluation of the repeating durability was performed in the same manner as in Example 1. The irradiation of laser light was performed 10 times with the aforementioned conditions, and then the conveying container was visually observed. As a result, a laser light irradiation mark was observed on the conveying container. The results are presented in Table 1-2.

TABLE 1-1

| | Conveying container Image Recording (%) | | Thermoreversible Recording Medium Image Recording (%) | |
|---|---|---|---|---|
| | Reflectance/ 980 nm | Absorbance:B/ 980 nm | Reflectance/ 980 nm | Absorbance:A/ 980 nm |
| Ex. 1 | 83.5 | 16.5 | 65.4 | 34.6 |
| Ex. 2 | 79.2 | 20.8 | 65.4 | 34.6 |
| Ex. 3 | 62.1 | 37.9 | 65.4 | 34.6 |
| Ex. 4 | 65.1 | 34.9 | 65.4 | 34.6 |
| Ex. 5 | 16.3 | 83.7 | 65.4 | 34.6 |
| Comp. Ex. 1 | 4.9 | 95.1 | 65.4 | 34.6 |
| Comp. Ex. 2 | 10.9 | 89.1 | 65.4 | 34.6 |

TABLE 1-2

| | A + 50 > B | A + 10 > B | A > B | Repeating durability | |
|---|---|---|---|---|---|
| Ex. 1 | Yes | Yes | Yes | 100 times or more | A |
| Ex. 2 | Yes | Yes | Yes | 100 times or more | A |
| Ex. 3 | Yes | Yes | No | 80 times | B |
| Ex. 4 | Yes | Yes | No | 80 times | B |
| Ex. 5 | Yes | No | No | 40 times | B |
| Comp. Ex. 1 | No | No | No | 1 time | C |
| Comp. Ex. 2 | No | No | No | 10 times | C |

Production Example 2

Production of Thermoreversible Recording Medium

A thermoreversible recording medium, a color tone of which was reversibly changed, was produced in the following manner.

—Support—

As for the support, a white polyester film (Tetron (registered trade mark) Film U2L98W, manufactured by Teijin DuPont Films Japan Limited) having the average thickness of 125 μm was provided.

—Thermosensitive Recording Layer—

By means of a ball mill, 6 parts by mass of octadecylphosphonic acid serving as a color developer, 16 parts by mass of a 10% by mass polyvinyl acetoacetyl solution (KS-1, manufactured by SekisuiChemical Co., Ltd.), 12 parts by mass of toluene, and 3 parts by mass of methyl ethyl ketone were ground and dispersed until the average particle diameter thereof was to be about 0.3 μm. To the resulting dispersion liquid, 1.5 parts by mass of 2-anilino-3-methyl-6-dimethylaminofluorene serving as a leuco dye, and 0.37 parts by mass of a 1.85% by mass $LaB_6$ dispersion liquid (KHF-7A, manufactured by Sumitomo Metal Mining Co., Ltd.) serving as a photothermal converting material, were added. The resulting mixture was sufficiently stirred, to thereby prepare a thermosensitive recording layer coating liquid. Subsequently, the obtained thermosensitive recording layer coating liquid was applied onto the support using a wire bar. The applied thermosensitive recording layer coating liquid was heated for 2 minutes at 60° C. to dry, to thereby form a thermosensitive recording layer having the average thickness of 10 μm.

—Protective Layer—

By means of a ball mill, 3 parts by mass of silica (P-832, manufactured by Mizusawa Industrial Chemicals, Ltd.), 3 parts by mass of a 10% by mass polyvinyl acetoacetyl solution (KS-1, manufactured by SekisuiChemical Co., Ltd.), and 14 parts by mass of methyl ethyl ketone were ground and dispersed until the average particle diameter thereof was to be about 0.3 μm. To the resulting dispersion liquid, 12 parts by mass of a 12.5% by mass silicone-modified polyvinyl butyral solution (SP-712, manufactured by Dainichiseika Color & Chemicals Mfg Co., Ltd.), and 24 parts by mass of methyl ethyl ketone were added, and the resulting mixture was sufficiently stirred to thereby prepare a protective layer coating liquid. Subsequently, the protective layer coating liquid was applied to the thermosensitive recording layer using a wire bar. The applied protective layer coating liquid was heated for 2 minutes at 60° C. to dry, to thereby form a protective layer having a thickness of 1 μm.

—Bonding Agent Layer—

A bonding agent layer coating liquid was prepared by sufficiently stirring 4 parts by mass of an acryl-based bonding agent (SK-Dyne 1720DT, manufactured by Soken Chemical & Engineering Co., Ltd.), 1 part by mass of a curing agent (L-45E, manufactured by Soken Chemical & Engineering Co., Ltd.), and 5 parts by mass of ethyl acetate. The obtained bonding agent layer coating liquid was applied with a wire bar on a surface of the support that was opposite to the surface thereof where the thermosensitive recording layer had been formed. The applied bonding agent layer coating liquid was heated for 2 minutes at 80° C. to dry, to thereby form a bonding agent layer having a thickness of 20 μm. In the manner as described above, a thermosensitive recording medium of Production Example 2 was produced.

Figure 15:
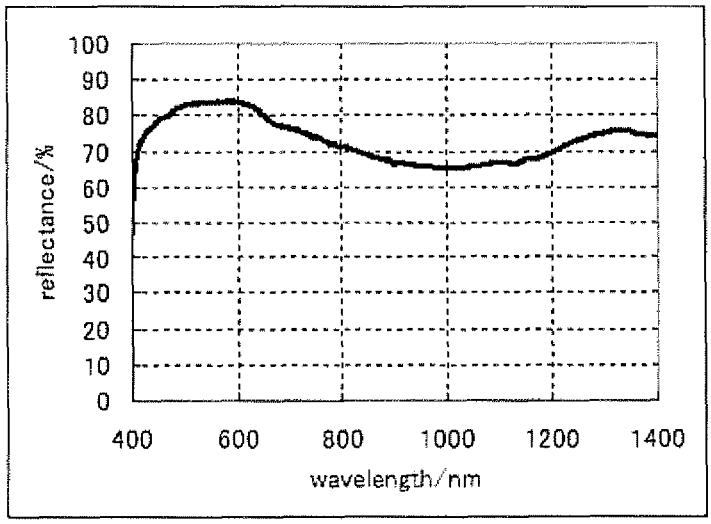
FIG. 15 is a graph depicting reflection properties of the thermosensitive recording medium of Production Example 2.

Next, a reflectance of the thermosensitive recording medium of Production Example 2 was measured by means of an integrating sphere photometer (U-4100, manufactured by Hitachi High-Technologies Corporation). The result is depicted in FIG. 15.

It could be read from the result of FIG. 7 that the reflectance thereof at the wavelength of 980 nm (at the time of image recording) was 65.4%, and thus the absorbance of the thermosensitive recording medium at the wavelength of 980 nm (at the time of image recording) was 34.6%.

Subsequently, laser light having a center wavelength of 980 nm was applied on the thermosensitive recording medium by means of Ricoh Rewritable Laser Marker (LDM200-110, manufactured by Ricoh Company Limited) under the conditions where the output was 20.3 W, the irradiation distance was 150 mm, the spot diameter was 0.48 mm, and the scanning speed was 1,000 mm/s, to thereby record a solid square image having a height of 8.0 mm, and a width of 8.0 mm.

The image recording was performed once under the aforementioned conditions. Then, visual observation was performed. As a result, it was confirmed that recording of the solid square image could be performed.

Example 6

A reflectance of a conveying container (a cube, W: 40 cm, D: 30 cm, H: 30 cm) formed of a yellow polypropylene propylene(PP) resin plate having a thickness of 2 mm, which was identical to that of Example 1, was measured by means of an integrating sphere photometer (U-4100, manufactured by Hitachi High-Technologies Corporation). The results are depicted in FIG. 8 and Table 2. With a wavelength (980 nm) of the laser light emitted at the time of the image recording, the absorbance A (34.6%) of the thermoreversible recording medium serving as the recording part and the absorbance B (16.5%) of the conveying container satisfied the following formula A+50>B.

Subsequently, laser light having a center wavelength of 980 nm was applied to the conveying container, to which the thermosensitive recording medium had been bonded as a recording part, by means of Ricoh Rewritable Laser Marker (LDM200-110, manufactured by Ricoh Company Limited) under the conditions where the output was 20.3 W, the irradiation distance of 150 mm, the spot diameter of 0.48 mm, and the scanning speed of 1,000 mm/s, to thereby write a solid square image having a height of 8.0 mm, and a width of 8.0 mm. This process was regarded as laser light irradiation performed once.

<Evaluation Method of Repeating Durability>

The irradiation of laser light was repeatedly performed with the aforementioned conditions 10 times with replacing the thermosensitive recording medium per every time laser light irradiation was performed. Thereafter, the conveying container was visually observed, but no laser light irradiation mark was observed on the conveying container. Moreover, the irradiation of laser light was performed repeatedly 100 times. Thereafter, the conveying container was visually observed, but no laser light irradiation mark was observed on the conveying container.

The repeating durability was evaluated based on the following evaluation criteria. The results are presented in Table 2.

[Evaluation Criteria]

A: No laser light irradiation mark was observed on the conveying container even after the laser light irradiation by the image recording device and the laser light irradiation by the image erasing device were repeated 100 times or more.

B: No laser light irradiation mark was observed on the conveying container even after the laser light irradiation by the image recording device and the laser light irradiation by the image erasing device were repeated 11 times or more but less than 100 times.

C: A laser light irradiation mark was observed on the conveying container, when the laser light irradiation by the image recording device and the laser light irradiation by the image erasing device were repeated 10 times or less.

TABLE 2

| | Conveying container Image recording (%) | | Thermosensitive recording medium Image recording (%) | | | | | | |
|---|---|---|---|---|---|---|---|---|---|
| Ex. 6 | Ref/ 980 nm | Absor. B/980 | Ref/ 980 nm | Absor. A/980 nm | A + 50 > B | A + 10 > B | A > B | Repeating durability | |
| | 83.5 | 16.5 | 65.4 | 34.6 | Yes | Yes | Yes | 100 times or more | A |

In Table 2 above, "Ref." denotes reflectance, and "Absor." denotes absorbance.

The embodiments of the present invention are, for example, as follows:

<1> A conveyor line system, containing:

an image processing device configured to irradiate a recording part with laser light to record or erase, or record and erase an image, wherein the conveyor line system is configured to manage a conveying container containing the recording part, and wherein the following formula is satisfied at a wavelength of the laser light emitted from the image processing device when recording the image:

$$A+50>B$$

where A is an absorbance of the recording part, and B is an absorbance of the conveying container.

<2> The conveyor line system according to <1>, wherein the following formula A>B is satisfied.

<3> The conveyor line system according to <1> or <2>, wherein the image recorded at the time of the image recording includes a solid image.

<4> The conveyor line system according to any one of <1> to <3>, further including a stopper configured to stop the conveying container at a predetermined position in front of the image processing device.

<5> The conveyor line system according to any one of <1> to <4>, wherein the image processing device contains an image recording device configured to irradiate the recording part with laser light to perform image recording, and an image erasing device configured to irradiate the recording part with laser light to perform image erasing, and wherein the image erasing device is provided at an upstream side of a conveying direction relative to the image recording device, and adjacent to the image recording device.

<6> The conveyor line system according to any one of <1> to <5>, wherein the recording part is a thermoreversible recording medium.

<7> The conveyor line system according to <6>, wherein the thermoreversible recording medium includes a support; and, on the support, a thermoreversible recording layer containing a photothermal converting material which absorbs light of a specific wavelength and converts the light to heat, a leuco dye, and a reversible color developer.

<8> The conveyor line system according to any one of <1> to <7>, wherein the conveying container is formed of a polypropylene resin.

<9> The conveyor line system according to any one of <1> to <8>, wherein the laser light is YAG laser, fiber laser, or semiconductor laser, or any combination thereof.

<10> The conveyor line system according to any one of <1> to <9>, wherein the wavelength of the laser light is 700 nm to 1,600 nm.

<11> The conveyor line system according to any one of <1> to <10>, wherein the conveyor line system is used for a physical distribution management system, a delivery management system, a storage management system, or a process management system in a factory, or any combination thereof.

<12> A conveying container, including:

a recording part to which an image is recorded by irradiating the recording part with laser light, wherein the conveying container is repeatedly used, and wherein the following formula is satisfied at a wavelength of the laser light emitted when recording the image:

$$A+50>B$$

where A is an absorbance of the recording part, and B is an absorbance of the conveying container.

<13> The conveying container according to <12>, wherein the recording part is a thermoreversible recording medium.

REFERENCE SIGNS LIST

001 conveyor line system
002 conveyor line
003 conveying direction of conveyor line
004 conveying container
005 thermoreversible recording medium
006 laser light of the image erasing device
007 laser light of the image recording device
008 image erasing device
009 image recording device
010 laser irradiation light of the image recording device
011 laser output of the image recording device
012 galvanometer mirror unit
013 reflective mirror
014 condenser lens
015 focal point position correcting unit
016 housing of an optical head of the image recording device
017 collimator lens unit
018 optic fiber
019 controlling unit of the image recording device
020 laser irradiation light of the image erasing device
021 laser output of the image erasing device
022 scanning mirror
023 optical lens (adjusting a beam width in a width direction)
024 optical lens (beam width adjustment in length and width directions)
025 optical lens (beam width adjustment in a width direction)
026 optical lens (lens for scattering laser light in a length direction)
027 optical lens (width-direction collimating unit)
028 reflective mirror
029 housing of the image erasing device
030 semiconductor laser array
031 cooling unit
100 thermoreversible recording medium
101 support
102 thermoreversible recording layer containing a photothermal converting material
103 first oxygen barrier layer
104 UV ray absorbing layer
105 second oxygen barrier layer

The invention claimed is:

1. A conveyor line system, comprising:

an image processing device configured to irradiate a recording part with laser light to record or erase, or record and erase an image, wherein the conveyor line system is configured to manage a conveying container containing the recording part, and wherein the following formula is satisfied at a wavelength of the laser light emitted from the image processing device when recording the image:

$$A+50>B$$

where A is an absorbance of the recording part, and B is an absorbance of the conveying container.

2. The conveyor line system according to claim 1, wherein the following formula A>B is satisfied.

3. The conveyor line system according to claim 1, wherein the image recorded at the time of the image recording comprises a solid image.

4. The conveyor line system according to claim 1, further comprising a stopper configured to stop the conveying container at a predetermined position in front of the image processing device.

5. The conveyor line system according to claim 1, wherein the image processing device comprises an image recording device configured to irradiate the recording part with laser light to perform image recording, and an image erasing device configured to irradiate the recording part with laser light to perform image erasing, and wherein the image erasing device is provided at an upstream side of a conveying direction relative to the image recording device, and adjacent to the image recording device.

6. The conveyor line system according to claim 1, wherein the recording part is a thermoreversible recording medium.

7. The conveyor line system according to claim 6, wherein the heat-reversible recording medium comprises a support; and, on the support, a heat-reversible recording layer containing a photothermal converting material which absorbs light of a specific wavelength and converts the light to heat, a leuco dye, and a reversible color developer.

8. The conveyor line system according to claim 1, wherein the conveying container is formed of a polypropylene resin.

9. The conveyor line system according to claim 1, wherein the laser light is YAG laser, fiber laser, or semiconductor laser, or any combination thereof.

10. The conveyor line system according to claim 1, wherein the wavelength of the laser light is 700 nm to 1,600 nm.

11. The conveyor line system according to claim 1, wherein the conveyor line system is used for a physical distribution management system, a delivery management system, a storage management system, or a process management system in a factory, or any combination thereof.

12. A conveying container, comprising:

a recording part to which an image is recorded by irradiating the recording part with laser light, wherein the conveying container is repeatedly used, and wherein the following formula is satisfied at a wavelength of the laser light emitted when recording the image:

$$A+50>B$$

where A is an absorbance of the recording part, and B is an absorbance of the conveying container.

13. The conveying container according to claim 12, wherein the recording part is a thermoreversible recording medium.

* * * * *